US009412271B2

(12) United States Patent
Sharma

(10) Patent No.: US 9,412,271 B2
(45) Date of Patent: Aug. 9, 2016

(54) TRAFFIC FLOW THROUGH AN INTERSECTION BY REDUCING PLATOON INTERFERENCE

(71) Applicant: Wavetronix LLC, Provo, UT (US)

(72) Inventor: Anuj Sharma, Lincoln, NE (US)

(73) Assignee: Wavetronix LLC, Provo, UT (US)

( * ) Notice: Subject to any disclaimer, the term of this patent is extended or adjusted under 35 U.S.C. 154(b) by 90 days.

(21) Appl. No.: 13/753,869

(22) Filed: Jan. 30, 2013

(65) Prior Publication Data

US 2014/0210645 A1 Jul. 31, 2014

(51) Int. Cl.

| | |
|---|---|
| ***G08G 1/07*** | (2006.01) |
| ***G08G 1/052*** | (2006.01) |
| ***G08G 1/056*** | (2006.01) |
| ***G08G 1/065*** | (2006.01) |
| ***G08G 1/08*** | (2006.01) |
| ***G08G 1/00*** | (2006.01) |

(52) U.S. Cl.

CPC ..... *G08G 1/052* (2013.01); *G08G 1/056* (2013.01); *G08G 1/065* (2013.01); *G08G 1/08* (2013.01); *G08G 1/22* (2013.01)

(58) Field of Classification Search

CPC ..... G08G 1/07; G08G 1/0104; G08G 1/20
USPC ..... 340/907, 909, 910, 932, 934; 701/117
See application file for complete search history.

(56) References Cited

U.S. PATENT DOCUMENTS 3,737,857 A 6/1973 Carman
3,819,919 A 6/1974 McGunigle
4,053,741 A 10/1977 Ainoya (Continued)

FOREIGN PATENT DOCUMENTS

CA 2512689 7/2004
DE 3414159 10/1985

(Continued)

OTHER PUBLICATIONS

Day, Christopher, et al. "Visualization and Assessment of Arterial Progression Quality using High Resolution Signal Event Data and Measured Travel Time", Mar. 5, 2010, Purdue University, 31 pages.*
U.S. Appl. No. 11/311,103, filed Dec. 19, 2005, Arnold.
Able, K.P., "A Radar Study of the Altitude of Nocturnal Passerine Migration," *Bird-Banding*, vol. 41, No. 4, Oct. 1970, 9 pages.
Beard, Jeffrey C., Arnold, David V., "6GHz Range Finder Using Pulse Compression," *IGARSS* 2000 (Hawaii).

(Continued)

*Primary Examiner* — Fekadeselassie Girma
*Assistant Examiner* — Stephen Burgdorf
(74) *Attorney, Agent, or Firm* — Workman Nydegger

(57) ABSTRACT

Methods, systems, and computer program products for optimizing automobile traffic flow through an intersection by detecting and reducing platoon interference. One method, performed in a computer product, includes steps of identifying a cluster in traffic information of a cycle of a traffic signal, determining that the cluster qualifies as an upstream platoon, calculating properties of the platoon, and generating an Enhanced Purdue Coordination Diagram (EPCD) for the cycle based on the calculated properties of the platoon. Another method includes obtaining, by a computer device, traffic information corresponding to an intersection; determining, by the computer device, platoon properties of the traffic information corresponding to each cycle of a traffic signal; and calculating, by the computer device, a timing change to make to the traffic signal to improve traffic flow through the intersection, the timing change being based on the platoon properties.

32 Claims, 15 Drawing Sheets

(56) References Cited

U.S. PATENT DOCUMENTS 4,167,330 A 9/1979 Haville
4,180,817 A 12/1979 Sanford
4,244,026 A 1/1981 Dickey
4,258,351 A 3/1981 Shigeta
4,317,117 A 2/1982 Chasek
RE31,044 E * 9/1982 McReynolds et al. ..... 701/118
4,370,718 A 1/1983 Chasek
4,430,636 A 2/1984 Bruce
4,658,334 A 4/1987 McSparran
4,659,982 A 4/1987 Van de Velde
4,674,073 A 6/1987 Naruse
4,700,191 A 10/1987 Mano
4,851,855 A 7/1989 Tsukamoto
4,866,438 A 9/1989 Knisch
4,908,615 A 3/1990 Bayraktaroglu
4,914,448 A 4/1990 Otsuka
4,914,449 A 4/1990 Fukuzawa
4,967,201 A 10/1990 Rich
4,977,406 A 12/1990 Tsukamoto
5,023,551 A 6/1991 Kleinberg et al.
5,066,950 A 11/1991 Schweitzer
5,122,961 A 6/1992 Toyama
5,161,107 A 11/1992 Mayeaux
5,204,682 A 4/1993 Beasley
5,243,528 A 9/1993 Lefebvre
5,262,783 A 11/1993 Philpott
5,278,554 A 1/1994 Marton
5,278,563 A 1/1994 Spiess
5,339,081 A 8/1994 Jefferis
5,402,346 A 3/1995 Lion
5,423,080 A 6/1995 Perret
5,446,395 A 8/1995 Goto
5,448,484 A 9/1995 Bulllock
5,504,490 A 4/1996 Brendle
5,504,659 A 4/1996 Acatay
5,510,990 A 4/1996 Hibino
5,555,036 A 9/1996 Harnett
5,572,450 A 11/1996 Worthy
5,581,249 A 12/1996 Yoshida
5,621,645 A 4/1997 Brady
5,663,720 A 9/1997 Weissman
5,668,739 A 9/1997 League
5,694,134 A 12/1997 Barnes
5,710,565 A 1/1998 Shirai
5,714,965 A 2/1998 Taguchi
5,716,301 A 2/1998 Wild
5,721,194 A 2/1998 Yandrofski
5,748,153 A 5/1998 McKinzie
5,757,307 A 5/1998 Nakatani
5,790,403 A 8/1998 Nakayama
5,793,309 A 8/1998 Nellson
5,793,491 A 8/1998 Wangler
5,798,983 A 8/1998 Kuhn
5,821,879 A 10/1998 Liepmann
5,828,339 A 10/1998 Patel
5,862,337 A 1/1999 Gray
5,878,367 A 3/1999 Lee
5,884,212 A 3/1999 Lion
5,920,280 A 7/1999 Okada
5,926,114 A 7/1999 Andrews
5,949,383 A 9/1999 Hayes
5,995,900 A 11/1999 Hsiao
6,011,515 A 1/2000 Radcliffe
6,037,894 A 3/2000 Pfizenmaier
6,049,205 A 4/2000 Taicher et al.
6,081,226 A 6/2000 Caldwell
6,091,355 A 7/2000 Cadotte
6,094,172 A 7/2000 Kascica
6,114,973 A 9/2000 Winner
6,118,405 A 9/2000 McKinnon
6,124,807 A 9/2000 Heckeroth
6,160,494 A 12/2000 Sodi
6,163,252 A 12/2000 Nishiwaki
6,177,885 B1 1/2001 Weil
6,195,019 B1 2/2001 Nagura
6,195,608 B1 2/2001 Berliner
6,198,437 B1 3/2001 Watson
6,204,778 B1 3/2001 Bergan
6,253,162 B1 6/2001 Jarman
6,266,627 B1 7/2001 Gatsonides
6,272,443 B1 8/2001 Motzko
6,366,870 B2 4/2002 Jarman
6,373,427 B1 4/2002 Hohne
6,377,191 B1 4/2002 Takubo
6,396,435 B1 5/2002 Fleischhauer
6,396,437 B1 5/2002 Marino
6,470,262 B2 10/2002 Kerner
6,490,519 B1 12/2002 Lapidot
6,556,916 B2 4/2003 Waite
6,577,269 B2 6/2003 Woodington
6,614,536 B1 9/2003 Deomens
6,657,554 B1 12/2003 Terashima
6,683,557 B2 1/2004 Pleva
6,693,557 B2 2/2004 Arnold
6,707,391 B1 3/2004 Monroe
6,707,419 B2 3/2004 Woodington
6,750,787 B2 6/2004 Hutchinson
6,781,523 B2 8/2004 Matsui
6,812,888 B2 11/2004 Drury
6,816,107 B2 11/2004 Pleva
6,856,876 B2 2/2005 Breed
6,876,949 B2 4/2005 Hilliard
6,879,281 B2 4/2005 Gresham
6,888,474 B2 5/2005 Sharp
6,959,259 B2 10/2005 Vock
7,089,422 B2 8/2006 Huntingdon
7,106,073 B1 9/2006 Bach et al.
7,317,406 B2 1/2008 Wolterman
7,324,015 B1 1/2008 Allen
7,327,280 B2 2/2008 Bachelder
7,408,479 B2 8/2008 Johnson
7,421,334 B2 9/2008 Dahlgren
7,426,450 B2 9/2008 Arnold
7,427,930 B2 9/2008 Arnold
7,501,976 B2 3/2009 Manor
7,573,400 B2 8/2009 Arnold
7,821,422 B2 * 10/2010 Hutchison et al. ..... 340/907
7,889,097 B1 2/2011 Arnold
7,889,098 B1 2/2011 Arnold
7,924,170 B1 4/2011 Arnold
8,948,995 B2 * 2/2015 Pandita ..... B60W 30/17 180/168
2001/0000948 A1 5/2001 Chen
2001/0045042 A1 11/2001 Theile
2002/0147534 A1 10/2002 Delcheccolo
2003/0212524 A1 11/2003 Cote et al.
2004/0083037 A1 4/2004 Yamane
2004/0119633 A1 6/2004 Oswald
2004/0227661 A1 11/2004 Godsy
2005/0046597 A1 3/2005 Hutchison
2005/0168331 A1 8/2005 Gunderson
2005/0231384 A1 10/2005 Shimotani
2005/0242306 A1 11/2005 Sirota
2006/0152405 A1 7/2006 Egri
2006/0155427 A1 7/2006 Yang
2006/0287807 A1 12/2006 Teffer
2007/0016359 A1 1/2007 Manor
2007/0096943 A1 5/2007 Arnold
2007/0152869 A1 7/2007 Woodington
2007/0208495 A1 9/2007 Chapman
2007/0222639 A1 9/2007 Giles
2008/0012726 A1 1/2008 Publicover
2008/0263080 A1 * 10/2008 Fukuma et al. ..... 707/102
2010/0069093 A1 * 3/2010 Morrison ..... 455/456.3
2010/0141479 A1 6/2010 Arnold
2010/0149020 A1 6/2010 Arnold
2010/0214126 A1 * 8/2010 Publicover ..... 340/907
2013/0013179 A1 1/2013 Lection et al.

(56) References Cited

U.S. PATENT DOCUMENTS

| | | | | |
|---|---|---|---|---|
| 2013/0286198 | A1* | 10/2013 | Fan et al. | 348/143 |
| 2014/0104310 | A1* | 4/2014 | Kandogan | 345/629 |

FOREIGN PATENT DOCUMENTS

| | | | | |
|---|---|---|---|---|
| DE | 4223119 | | 6/1993 | |
| DE | 19530065 | | 1/1997 | |
| DE | 19820704 | | 11/1999 | |
| EP | 129251 | | 12/1984 | |
| EP | 0642190 | | 3/1995 | |
| EP | 0716949 | | 6/1996 | |
| EP | 0940690 | | 3/1998 | |
| EP | 0945715 | | 3/1998 | |
| EP | 0954049 | | 4/1998 | |
| EP | 0978729 | | 8/1998 | |
| EP | 1180758 | | 2/2002 | |
| FR | 2812402 | | 2/2002 | |
| GB | 1443701 | | 7/1975 | |
| GB | 1586305 | | 3/1981 | |
| JP | 4084300 | | 3/1992 | |
| JP | 6263487 | | 6/1994 | |
| JP | 6162387 | | 6/2004 | |
| WO | WO8001782 | | 9/1980 | |
| WO | 8906808 | | 7/1989 | |
| WO | WO9908128 | | 2/1999 | |
| WO | WO0045462 | | 3/2000 | |
| WO | WO0113141 | | 2/2001 | |
| WO | WO0113142 | | 2/2001 | |
| WO | WO03027985 | | 4/2003 | |
| WO | WO03027986 | | 4/2003 | |
| WO | WO2004063682 | | 7/2004 | |
| WO | WO2007053350 | | 5/2007 | |
| WO | WO2007112284 | | 10/2007 | |
| WO | WO2007115218 | | 10/2007 | |
| WO | WO 2010103504 | A1 * | 9/2010 | G08G 1/08 |
| WO | WO2010144349 | | 12/2010 | |
| WO | WO2010144353 | | 12/2010 | |

OTHER PUBLICATIONS

Berka, S. et al., "New Perspectives for ATMS: Advanced Technologies in Traffic Detection," *Journal of Transportation Engineering*, Jan./Feb. 1998, 7 pages.

*Canadian Driver*, "Automatic Collision Avoidance System Unveiled," Jun. 12, 2002, http://www.canadiandriver.com/news/020612.htm, 3 pages.

Carlson, Brian, "Autoscope Clearing the Congestion: Vision Makes Traffic Control Intelligent" *Advanced Imaging*, Feb. 1997 5 pgs.

Derneryd, Anders G., "Linearly Polarized Microstrip Antennas," *IEEE Transactions of Antennas and Propagation*, Nov. 1976, pp. 846-851.

*Detection Technology: For IVHS*—vol. 1: "Final Report Addendum," Publication No. FHWA-RD-96-100, Jul. 1995, 8 pages.

Detector User Needs from the Traffic Signals Workshop Held in Seattle, WA. circa Jul. 2003, 42 pages.

*Econolite Control Products, Inc*. "Autoscope Automates 100% of Video Detection Set-Up: Introducing the Autoscope Wizard" Nov. 1, 2003, 2 pages.

*Econolite Control Products, Inc*. "Autoscope Solo Pro II Machine Vision Processor" 2003, 2 pgs.

*EIS Electronic Integrated Systems, Inc*, "RTMS Radar Traffic Detection—General Information," pp. 1-3, Available at least as early as Jul. 21, 2001.

*EIS Electronic Integrated Systems, Inc*, "RTMS Radar Traffic Detection—Traffic Detector Primer," pp. 1-4, Available at least as early as Jul. 21, 2001.

*EIS Electronic Integrated Systems, Inc*., "RTMS User Manual," Issue 3, Sep. 2000.

*Electronique Controle Mesure*, "LOREN Multi-Lane Microwave Detector," Available at least as early as Mar. 1, 2002, 2 pages.

*FCC Federal Communications Commission, Consumer & Government Affairs Bureau*, "Digital Radio—The Sound of the Future," http://www.fcc.gov/cgb/consumerfacts/digitalradio.html, Reviewed/Updated on Sep. 24, 2003, 3 pages.

Forman, Michael, and Popovic, Zoya, "A K-Band Ground-Backed CPW Balanced Coupler and Integrated Antenna Feed," *European Microwave Conference*, Oct. 2000, 4 pages.

Frederick, J.D., et al., "A Novel Single Card FMCW Radar Transceiver with on Board Monopulse Processing," Available at least as early as Mar. 1, 2002, 4 pgs.

Gern, Axel, et al., "Advanced Lane Recognition—Fusing Vision and Radar,:" *Proceedings of the IEEE Intelligent Vehicles Symposium 2000*, Dearborn (MI) USA, Oct. 3-5, 2000, 7 pages.

Giles, Bradley C. and Jarrett, Bryan R., "Benefits of Auto-Configuring Traffic Sensing Equipment," Aug. 2004, 17 pages.

Gille, Sarah T. and Llewellyn Smith, Stefan G. "Velocity Probability Density Functions for Altimetry," *Journal of Physical Oceanography*, vol. 30, Jan. 2000, 12 pages.

Gonzalez, Juan Pablo, et al., "Lane Detection Using Histogram-Based Segmentation and Decision Trees," *2000 IEEE Intelligent Transportation Systems Conference Proceedings*, Dearborn (MI) USA, Oct. 10, 2000, 6 pages.

Gresham, Ian, et al., "Ultra Wide Band 24 GHz Automotive Radar Front-end," 2003 *IEEE MTT-S Digest*, 4 pages.

Howard, Julie, "Venture Capitalists Break Cover; Stellar Tech Ends 4 Years of Keeping a Low Profile ," *The Idaho Statesman*, Sep. 9, 2003; http://www.idahostatesman.com/Business/story.asp?ID=48714, 2 pages.

*Idaho Business IQ*, "Stellar Opportunities; How One Idaho Investment Firm Views the State's Business Future," Idaho Business IQ, Nov./Dec. 2003, 5 pages.

*IMSA Journal*, "News Around the Industry, Spruce Meadows Partners," Nov./Dec. 2004, 4 pages.

*ISS & Econolite at Wavetronix*, "Dilemma Zone Detector (DZD): Summary Requirements" Jul. 18, 2003, 2 pages.

Jansson, Jonas, et al., "Decision Making for Collision Avoidance Systems," Copyright 2002, *Society of Automotive Engineers* Publication No. 2002-01-0403, 8 pages.

Kim, Ihn S., et al., "Two Novel Vehicle Detectors for the Replacement of a Conventional Detector," *Microwave Journal* (*International ed.*). Dedham: Jul. 2001 vol. 44, Iss. 7; http://proquest.umi.com/proxygw.wrlc.org/pqdlink?Ver. 7 pages.

Klein, Lawrence A., "Sensor Technologies and Data Requirements for ITS", Artech House, Norwood, MA, Jun. 2001, 739 pages.

Klotz, Michael, et al., "An Automotive Short Range High Resolution Pulse Radar Network," Jan. 2002.

Kolton, Greg, "Mobility Technologies Offers Exclusive Data and Technology with New Traffic Pulse Partner Program," Mobility Technologies, The Traffic.com People, Press Release, May 31, 2001, 6 pages.

Kotzenmacher, Jerry, et al., "Evaluation of Non-Intrusive Traffic Detection System," *2004 North American Travel Monitoring Exhibition & Conference* (*NATMEC*), Jun. 27, 2004, 13 pages.

Kramer, Gerd, "Envisioning a Radar-Based Automatic Road Transportation System," *Intelligent Transportation Systems*, May/Jun. 2001, 3 pages.

Liu, Huan-Chang, et al., "Radiation of Printed Antennas with a Coplanar Waveguide Feed," *IEEE Transactions on Antennas and Propagation*, vol. 43, No. 10, Oct. 1995, pp. 1143-1148.

Ma, Bing, et al., "Road and Lane Edge Detection with Multisensor Fusion Methods," I*EEE Publication* No. 0-7803-5467-2/99 Copyright 1999.

Manor, Daniel, "Spider: A Wireless Solution for Mid-block Detection," *IMSA Journal*, Mar./Apr. 2003, 6 pages.

Mende, Ralph Dr., et al., "A 24 GHz ACC Radar Sensor," *Smart Microwave Sensors GmbH*, Feb. 28, 2005.

Mende, Ralph, "The UMRR 24GHz Radar Sensor Family for Short and Medium Range Applications," *Smart Microwave Sensors GmbH*, Apr. 8, 2004.

Mende, Ralph, "UMRR: A 24GHz Medium Range Radar Platform," *Smart Microwave Sensors GmbH*, Jul. 25, 2003.

Metzler, T., "Microstrip Series Arrays," *IEEE Transactions on Antennas and Propagation*, vol. AP-29, No. 1, Jan. 1981, pp. 174-178.

Middleton, Dan and Parker, Rick, "Initial Evaluation of Selected Detectors to Replace Inductive Loops on Freeways, Report No.

(56) References Cited

OTHER PUBLICATIONS

FHWA/TX-00/1439-7," *Texas Transportation Institute*, on behalf of the Texas Department of Transportation; Construction Division, Apr. 2000, 90 pages.
*Millimeter Wave Radar Traffic Sensor AutoTrak*, Transportation Systems, Aug. 17, 2004 2 pages.
*MS Sedco, Motion Sensors*, "TC26-B Microprocessor-Controlled Vehicle Detector," Available at least as early as Mar. 1, 2002, at www.microwavesensors.com/motionsensors.html 6 pages.
*Naztec ATMS Solutions*, "Accuwave LX-150 Microwave Detector," Sugar Land, Texas; Available at least as early as Mar. 1, 2002, 3 pages.
Nunez-Garcia, Javier, et al., "Random Sets and Histograms," *Control Systems Center, UMIST, Fuzz-IEEE* 2001:1183-1186, http://www.umist/ac.uk/csc 2001, 6 pages.
On-Bench Photographs of Detectors, pp. 1-9, Available at least as early as Jan. 16, 2002 at http://ntl.bts.gov/DOCS/96100/ch04/body_ch04_04.html.
Palen, J. "A Watching Brief," *Traffic Technology International* Oct./Nov. 2001 p. 43-46.
Pilutti, Tom, et al., "Identification of Driver State for Lane-Keeping Tasks" *IEEE Transaction on Systems, Man, and Cybernetics—Part A Systems and Humans*, vol. 29, No. 5, Sep. 1999, 17 pages.
Pordage, P. et al., "Technology at the Crossroads: New Radar Sensor Allows Pedestrians and Traffic to Coexist," *Cambridge Consultants* Feb. 24, 2004.
Pumrin, S., et al., "Roadside Camera Motion Detection for Automated Speed Measurement," *The IEEE 5th International Conference on Intelligent Transportation Systems*, Sep. 30, 2002, Singapore, 5 pages.
*Railway Grade Crossing Sensor*,Transportation Systems, Aug. 17, 2004 1 page.
*Optisoft the Intelligent Traffic Signal Platform*, "Red Light Hold Radar-based System Prevents Collisions from Red Light Runners" Available at least as early as Aug. 30, 2010, 2 pages.
Reijmers, Han, et al., "Performance Analysis of Slotted Aloha on a Three Lane Motorway Using Measured Vehicle Positions," *IEEE* Publication No. 0-7803-3659-3/97, Copyright 1997 IEEE, 5 pages.
Reijmers, Han, et al., "The Influence of Vehicle Distribution Models on Packet Success Probability on a Three Lane Motorway," *IEEE* Publication No. 0-7803-4320-4/98, Copyright 1998 IEEE, 5 pages.
Rivenq-Menhaj, et al., "Combining Two Radar Techniques to Implement a Collision Avoidance System," *IOP Electronic Journals, Measurement Science and Technology*, www.iop.org/EJ/abstract/09570233/9/8/030, from Meas. Sci Technol. 9 1343-1346, Aug. 1998, 2 pages.
Saito, Atsuchi, "Image Sensor for Measuring Volumes By Direction" *International Sales & Marketing Department Social Systems Solution & Service Business Company OMRON Corporation*, Tokyo Japan ITS World Congress Oct. 2004 1 page.
Sakai, Yasunobu, et al., "Optical Spatial filter Sensor for Ground Speed," Presented at the *International Commission of Optics Topical Meeting*, Kyoto, 1994, Optical Review, vol. 2, No. 1 (1995), 3 pages.
Schoepflin, Todd N., et al., "Dynamic Camera Calibration of Roadside Traffic Management Cameras," *The IEEE 5th International Conference on Intelligent Transportation Systems*, Sep. 3-6, 2002, Singapore, 6 pages.
Sensys RS240 Radar Sensor, circa Oct. 2002.
*SmarTek Systems, Inc.* "SmarTek Acoustic Sensor—"Version 1 (SAS-1) Installation and Setup Guide; Apr. 3, 2003.
*SmarTek Systems, Sensing and System Integration Solutions*, "The SAS 1 Passive Acoustic Vehicle Detector" Jan. 14, 2002, 2 pages.
SmartSensor Installation Guide WaveTronix Copyright 2004 pp. 1-26.
Smith, Ryan L., et al., "Development of a Low Cost, FM/CW Transmitter for Remote Sensing," IGARSS 2000 (Hawaii).
*SpeedInfo less traffic, more time*, "DVSS-1000 Installation Manual and Users Guide," Rev. 2.0, Feb. 18, 2004, 10 pages.
*Applied Concepts, Inc.*, "Stalker Lidar Operator Manual," Copyright 2000.
Stevenage, Herts, "IF Digital Generation of FMCW Waveforms for Wideband Channel Characterization," *IEEE Proceedings-I*, vol. 139, Jun. 1992 pp. 281-288.
Stewart, B.D., etal "Adaptive Lane Finding in Road Traffic Image Analysis" University, Edinburgh, UK Road, Traffic Monitoring and Control, Apr. 26-28, 1994 Conference Publication No. 391, IEEE, 1994 pp. 133-136.
Swangnate et al., A Conductor-Backed Coplanar Waveguide Direction Coupler for Varactor-Tuned Phase Shifting, Journal of KMITNB, vol. 12, No. 2, Apr.-Jun. 2002, 5 pages.
Transportation Operations Group—Sensors, TTI Workshop on Vehicle Detection, TexITE Meeting, College Station, Texas, Jun. 22, 2000, 37pages, Available at: http://trasops.tamu.edu/content/sensors.cfm.
*Optisoft the Intelligent Traffic Signal Platform*, "Transportation Sensors Optional Features for the OptiSoft ITS Platform" Available at Least as Early as Aug. 30, 2010 1 pages.
*U.S. Department of Transportaion Federal Highway Administration*, "Field Test of Monitoring of Urban Vehicle Operations Using Non-Intrusive Technologies, Final Report," May 1997, 123 pages.
University Research in Support of the Department of Transportation Program on Remote Sensing Applications in Transportation (DTRS56-00-BAA-0004) Nov. 1999.
Veeraraghavan, Harini, et al., "Computer Vision Algorithms for Intersection Monitoring" *IEEE Transactions on Intelligent Transportation Systems*, vol. 4, No. 2, Jun. 2003.
Waite, Jonathan L, and Arnold, David W. "Interferometric Radar Principles in Track Hazard Detection to Improve Safety," *IGASRSS* 2000 (Hawaii).
Walkenhorst, Brett T., et al., "A Low cost, Radio Controlled Blimp as a Platform for Remote Sensing," 2000 (Hawaii).
Waner, Stefan and Costenoble, Steven R., "Calculus Applied to Probability and Statistics," *Calculus and Probability*, Sep. 2, 1996, http://people/hofstra.edu/faculty/Stefant_Waner/cprob/cprob2.html, 13 pages.
Wilson, Christopher K.H., et al., "The Potential of Precision Maps in Intelligent Vehicles," *Proceeding of IEEE Internaltion Conference on Intelligent Vehicles*, IEEE Oct. 1998, 4 pages.
Yang, Li, et al., "Bi-Mode Time-Space Multiplexing Antenna Array for Multi-Targets Detection in Automotive Application," *IEEE Publication* No. 0-7803-7070-8/01, Copyright 2001 IEEE, 4 pages.
Yellin, Daniel, et al., "An Algorithm for Dual-Chanel Noiseless Signal Reconstruction and its Performance Analysis," *IEEE Transactions on Signal Processing*, vol. 47, No. 6, Jun. 1999, 17 pages.
Yung, N.H.C., et al., "Vehicle-Type Identification through Automated Virtual Loop Assignment and Block-Based Direction biased Motion Estimation," *IEEE Publication* No. 0-7893-4975-X/98, Copyright 1999 IEEE, 5 pages.
Zaugg, David A., et al., "Ocean Surface and Landslide Probing with a Scanning Radar Altimeter," *IGARSS* 2000 (Hawaii).
U.S. Appl. No. 12/546,219, Mar. 11, 2010, Notice of Allowance.
U.S. Appl. No. 12/546,219, Oct. 22, 2010, Notice of Allowance.
U.S. Appl. No. 12/546,219, Dec. 6, 2010, Notice of Allowance.
U.S. Appl. No. 11/614,250, Jul. 24, 2009, Office Action.
U.S. Appl. No. 11/614,250, Nov. 4, 2009, Office Action.
U.S. Appl. No. 11/614,250, Mar. 11, 2010, Notice of Allowance.
U.S. Appl. No. 11/614,250, Jun. 1, 2010, Notice of Allowance.
U.S. Appl. No. 11/614,250, Oct. 20, 2010, Notice of Allowance.
U.S. Appl. No. 11/614,250, Dec. 6, 2010, Notice of Allowance.
U.S. Appl. No. 11/689,441, Jan. 8, 2010, Office Action.
U.S. Appl. No. 11/689,441, Jun. 16, 2010, Notice of Allowance.
U.S. Appl. No. 11/689,441, Sep. 9, 2010, Notice of Allowance.
U.S. Appl. No. 11/689,441, Dec. 10, 2010, Notice of Allowance.
U.S. Appl. No. 11/689,441, Mar. 29, 2011, Notice of Allowance.
U.S. Appl. No. 12/546,196, Nov. 5, 2009, Notice of Allowance.
U.S. Appl. No. 12/546,196, Feb. 26, 2010, Notice of Allowance.
U.S. Appl. No. 12/546,196, Jun. 24, 2010, Notice of Allowance.
U.S. Appl. No. 12/546,196, Sep. 27, 2010, Notice of Allowance.
U.S. Appl. No. 12/546,196, Dec. 6, 2010, Notice of Allowance.
U.S. Appl. No. 09/966,146, Sep. 10, 2002, Office Action.
U.S. Appl. No. 09/966,146, Dec. 31, 2002, Notice of Allowance.
U.S. Appl. No. 09/964,668, Nov. 6, 2002, Office Action.
U.S. Appl. No. 09/964,668, Oct. 1, 2003, Notice of Allowance.

(56) References Cited

OTHER PUBLICATIONS

U.S. Appl. No. 10/744,686, Mar. 9, 2005, Office Action.
U.S. Appl. No. 10/744,686, Jun. 24, 2005, Office Action.
U.S. Appl. No. 10/744,686, Dec. 2, 2005, Notice of Allowance.
U.S. Appl. No. 10/744,686, Jan. 29, 2007, Office Action.
U.S. Appl. No. 10/744,686, Aug. 9, 2007, Notice of Allowance.
U.S. Appl. No. 10/744,686, Mar. 7, 2008, Notice of Allowance.
U.S. Appl. No. 10/754,217, Apr. 22, 2005, Office Action.
U.S. Appl. No. 10/754,217, Nov. 17, 2005, Office Action.
U.S. Appl. No. 10/754,217, Feb. 28, 2006, Notice of Allowance.
U.S. Appl. No. 10/754,217, Jun. 20, 2006, Office Action.
U.S. Appl. No. 10/754,217, Jan. 11, 2007, Office Action.
U.S. Appl. No. 10/754,217, Aug. 17, 2007, Notice of Allowance.
U.S. Appl. No. 10/754,217, Oct. 11, 2007, Office Action.
U.S. Appl. No. 10/754,217, Apr. 8, 2008, Notice of Allowance.
U.S. Appl. No. 11/264,339, Apr. 6, 2009, Notice of Allowance.
U.S. Appl. No. 12/546,219, Jun. 10, 2010, Notice of Allowance.
U.S. Appl. No. 12/546,196, Jan. 27, 2010, Notice of Allowance.
U.S. Appl. No. 12/502,965, Nov. 15, 2011, Notice of Allowance.
International Search Report for PCT/US2010/037602 dated Aug. 6, 2010.
Written Opinion for PCT/US2010/037602 dated Aug. 6, 2010.
Day, Christopher M., et al., "Reliability, Flexibility, and Environmental Impact of Alternative Arterial Offset Optimization Objective Functions" *TRB 2011 Annual Meeting*, Nov. 15, 2010, 32 pages.
Day, Christopher M., et al., "Computational Efficiency of Alternative Arterial Offset Optimization Algorithms" *TRB 2011 Annual Meeting*, Nov. 15, 2010, 31 pages.
Brennan, Thomas M., et al, "Visual Education Tools to Illustrate Coordination System Operation" *TRB 2011 Annual Meeting*, Nov. 15, 2010, 29 pages.
Liu, Henry X., et al., "Development of a Real-Time Arterial Performance Monitoring System Using Traffic Data Available for Existing Signal Systems" *Minnesota Department of Tranportation Report*, Dec. 2008, 117 pages.
Smarglik, Edward J., et al., "Event-Based Data Collection for Generating Actuated Controller Performance Measures" *Journal of the Transportation Research Board*, No. 2035, 2007. pp. 97-106.
U.S. Appl. No. 12/710,736, Mar. 26, 2013, Office Action.
U.S. Appl. No. 14/164,102, Jan. 24, 2014, Arnold et al.
International Search Report and Written Opinion for PCT/US2014/013412 mailed May 22, 2014.
Diker, Ahmet Can, et al. "Estimation of Traffic Congestion Level via FN-DBSCAN Algorithm by Using GPS Data," IV International Conference, PCI'2012, 2012, retrieved on [Jun. 5, 2014]. Retrieved from internet: <URL:http://www.pci2012:science.az/1/19.pdf> entire document.
Wang, et al. "Coordinated Vehicle Platoon Control: Weighted and Constrained Consensus and Communication Network Topologies," 51st IEEE Conference on Decision and Control, 2012, retrieved on [Jun. 5, 2014]. Retrieved from the Internet: <URL: http://www.cs.wayne.edu/-hzhang/group/publications/pltCDC.pdf> entire document.
U.S. Appl. No. 12/710,736, Oct. 15, 2013, Notice of Allowance.
"Duraline Introduces Roadway Lighting Break-Away Systems," *Industry News*, Aug. 9, 2002, available at http://news.thomasnet.com/fullstory/roadway-lighting-disconnects-if-knocked-over-13184.
Baker, "Grounding and Bonding—Part 3: Introduction and Resources," *IMSA Journal*, 2 pages.
Buczowski, "Automatic Lane Detection," 4 pages.
Dailey, "A Statistical Algorithm for Estimating Speed from Single Loop Volume and Occupancy Measurements," Transportation Research Part B 33 (1999) p. 313-322.
Day et al., "Visualization and Assessment of Arterial Progression Quality Using High Resolution Signal Event Data and Measured Travel Time," Mar. 5, 2010, Purdue University, 31 pages.
European Search Report for EP04701207 dated Oct. 23, 2006.
European Search Report for EP1435036 dated Mar. 9, 2006.
European Search Report for EP1438702 dated Mar. 15, 2005.
Examination Report dated Mar. 29, 2007 from European Patent Application No. 04 701 207.5, 3 pages.
Examination Report for Canadian Paten Application No. 2434756 dated Dec. 19, 2006.
Examination Report for EPO Patent Application No. 02770445.1-2220.
Examination Report for EPO Patent Application No. 02775735.0-2215 dated Jun. 12, 2006.
Examination Report from Canadian Patent Application No. 2461411 dated Oct. 10, 2006.
Examination Report from Canadian Patent Application No. 2512689 dated Sep. 30, 2010.
Federal Register, Jun. 1, 2001, vol. 66, No. 106, Participation in the Intelligent Transportation Infrastructure Program, 2 pages.
International Preliminary Examination Report for PCT/US02/27682 dated Sep. 2, 2004.
International Preliminary Search Report for PCT/US02/27630 dated Aug. 16, 2004.
International Search Report and Written Opinion from PCT/US2007/064711 dated Sep. 4, 2008.
International Search Report and Written Opinion from PCT/US2010/037596 dated Aug. 19, 2010.
International Search Report for PCT/US02/27630 dated Dec. 3, 2002.
International Search Report for PCT/US02/27682 dated Jun. 20, 2003.
International Search Report for PCT/US2004/00471 dated Aug. 31, 2005.
International Search Report for PCT/US2006/41324 dated May 1, 2007.
Merlo, "Automotive Radar for the Prevention of Collisions," IEEE, Feb. 1964.
NASA Jet Propulsion Laboratory: California Institute of Technology, "Ocean Surface Topography from Space-Technology", available at https://sealevel.jpl.nasa.gov/technology/.
Sensor Technologies & Systems, Inc. AutoTrak Intelligent Transportation Systems/Advanced Traffic Management Systems Aug. 17, 2004 2 pgs.
Task Force L Final Report, Executive Summary, pp. 1-40, Available at least as early as Jan. 16, 2002.
Transportation Operations Group—Sensors, pp. 1-13, Available at least as early as Jul. 21, 2001.
Transportation Operations Group, "Sensors," p. 1-13.
Weil, et al., "Across-the-Road Photo Traffic Radar: New Calibration Techniques," Electromagnetics Division (818.02), National Institute of Standards and Technology, 4 pages.
Written Opinion for PCT/US02/27630 dated Jun. 11, 2003.
U.S. Appl. No. 10/744,686, Nov. 21, 2007, Notice of Allowance.
U.S. Appl. No. 12/502,965, Feb. 27, 2012, Notice of Allowance.
SCOOT Advice Leaflet 1: The "SCOOT" Urban Traffic Control System; http://www.scoot-utc.com/documents/1_SCOOT-UTC; Nov. 14, 2012.
U.S. Appl. No. 14/962,377, Dec. 8, 2015, Arnold et al.
Atlantic Scientific Corporation: corporate overview. 6 pages.
Detection Technology for IVHS: 2. Synopsis of Final Report (1996) https://www.fhwa.dot.gov/publications/research/operations/ivhs/chapter2.cfm.
European Search Report for EP02775735 dated Mar. 9, 2006.
Executive Summary: Scope of the Study http://www.tfhrc.gov/advanc/ivhs/chapter1.htm.
ITS Decision, Other Roadside Detectors, Intelligent Transportation Systems—Traffic Surveillance.
Lawson, "Case Histories Keeping That Cargo Dry and Viable".
McKeon, "John Foster: Stellar Technologies".
Reynolds, Desiccant City: Case Histories: Award Winners, "Technical Achievements Shine Among FPA Winners".
U.S. Appl. No. 14/164,102, Sep. 25, 2015, Notice of Allowance.

* cited by examiner

TRAFFIC FLOW THROUGH AN INTERSECTION BY REDUCING PLATOON INTERFERENCE

BACKGROUND OF THE INVENTION

1. The Field of the Invention

The present invention relates to methods, systems, and computer program products for optimizing automobile traffic flow. More specifically, the present invention relates to optimizing automobile traffic flow through an intersection by detecting and reducing platoon interference.

2. The Relevant Technology

A roadway intersection is a planned point of conflict in a roadway system. That is, vehicles, pedestrians, cyclists, and other roadway users come together from various directions at the roadway intersection. With different crossing and entering movements by both drivers and pedestrians, an intersection is one of the most complex traffic situations that motorists encounter. To allow traffic from different directions to safely pass through, the intersection is often signalized. To signalize an intersection, one or more traffic signals are used. The traffic signals include signal lights (typically red, yellow, and green) to indicate to vehicles from each of the approaching roadways when it is safe to pass through the intersection. The signal lights of the intersection are controlled by a traffic signal controller to allow non-conflicting traffic to concurrently pass through the intersection while preventing conflicting traffic from doing so. As a result, vehicles arriving at the intersection from one approach direction are periodically required to stop to allow vehicles arriving from another approach direction to pass through the intersection.

While traffic signals help to maintain order and safety at intersections, they come with a cost; because some vehicles are required to stop at the intersection for a period of time, the flow of traffic is negatively impacted. As a result, roadway intersections are one of the main causes of traffic congestion. Although a traffic signal will always have an impact on traffic flow, that impact can be minimized by doing a number of things. For example, traffic signal controllers at consecutive signalized intersections along a busy roadway can be coordinated to allow traffic to flow at a generally constant speed through the corresponding intersections. As another example, the timing of the various phases of the traffic signal cycle can be modified to match the flow of traffic. That is, the timing of each signal light (e.g., red, yellow, and green) corresponding to the various phases can be optimized to cause the least amount of traffic congestion.

While the above techniques can help to minimize traffic congestion, today's traffic engineers face a huge challenge in implementing them. Generally, the best tool traffic engineers have to improve the timing of traffic signals is to physically visit each intersection in person and make observations. However, personal visits can be time consuming and the observations from the visit are limited in sample size. Because of the amount of time this can take, the traffic engineer often simply lets complaints from the motoring public dictate the intersections that receive attention.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope. In the drawings, like numerals designate like elements. Furthermore, multiple instances of an element may each include separate letters appended to the element number. For example two instances of a particular element "20" may be labeled as "20a" and "20b". In that case, the element label may be used without an appended letter (e.g., "20") to generally refer to every instance of the element; while the element label will include an appended letter (e.g., "20a") to refer to a specific instance of the element.

DETAILED DESCRIPTION OF THE PREFERRED EMBODIMENTS

Figure 1:
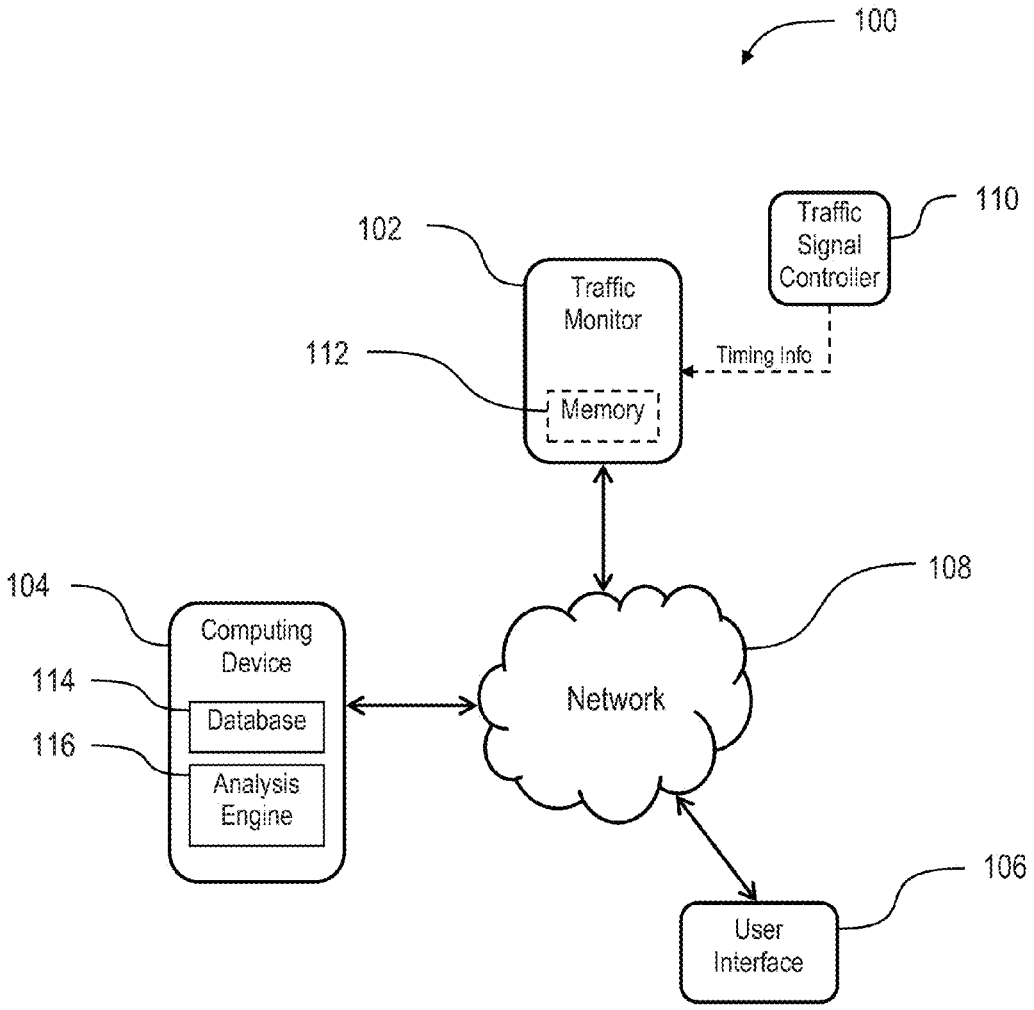
FIG. 1 is a block diagram of a system incorporating features of the present invention.

In the following detailed description, reference is made to the accompanying drawings, which form a part hereof. In the drawings, similar symbols typically identify similar components, unless context dictates otherwise. The embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein. It will also be understood that any reference to a first, second, etc. element in the claims or in the detailed description, is not meant to imply numerical sequence, but is meant to distinguish one element from another unless explicitly noted as implying numerical sequence.

In addition, as used in the specification and appended claims, directional terms, such as "top," "bottom," "up," "down," "upper," "lower," "proximal," "distal," "horizontal," "vertical," and the like are used herein solely to indicate relative directions and are not otherwise intended to limit the scope of the invention or claims.

The present invention relates to methods, systems, and computer program products for optimizing traffic flow. In particular, embodiments of the present invention provide innovative methods for improving traffic flow through a signalized intersection by automatically detecting and easing or even eliminating platoon interference.

In this specification and in the following claims, the term "roadway intersection" is defined as the intersection of two or more roadways for motorized vehicular traffic and also includes an intersection of roadways with one or more thoroughfares for other traffic, such as pedestrian paths, bicycle paths, and railways. The roadway intersection includes the approaches to the intersection. A "platoon" is defined herein as a group of vehicles that remain closely bunched together as the vehicles travel along a roadway.

Embodiments of the present invention may comprise or utilize a special purpose or general-purpose computer including computer hardware, such as, for example, one or more processors and system memory, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media (devices). Computer-readable media that carry computer-executable instructions are transmission media. Thus, by way of example, and not limitation, embodiments of the invention can comprise at least different kinds of computer-readable media: computer storage media and transmission media.

Computer storage media includes RAM, ROM, EEPROM, CD-ROM, solid state drives ("SSDs") (e.g., based on RAM), flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired and wireless) to a computer, the computer properly views the connection as a transmission medium. Transmission media can include network and/or data links which can be used to carry desired program code means in the form of computer-executable instructions or data structures and which can be accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (or vice versa). For example, computer-executable instructions or data structures received over a network or data link can be buffered in RAM within a network interface module (e.g., a network interface controller (NIC)), and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which cause a general purpose computer, special purpose computer, or special purpose processing device to perform a certain function or group of functions. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

By way of example, and not limitation, common network environments that can be used with the present invention include Local Area Networks ("LANs"), Wide Area Networks ("WANs"), and the Internet. Accordingly, each of the computer systems as well as any other connected computer systems and their components, can create message related data and exchange message related data as needed (e.g., Internet Protocol ("IP") datagrams and other higher layer protocols that utilize IP datagrams, such as, Transmission Control Protocol ("TCP"), Hypertext Transfer Protocol ("HTTP"), User Datagram Protocol ("UDP"), etc.) over the network.

Those skilled in the art will appreciate that the invention may be practiced in network computing environments with many types of computer system configurations, including: personal computers, desktop computers, laptop computers, message processors, hand-held devices, multi-processor systems, microprocessor-based or programmable consumer electronics, network PCs, minicomputers, mainframe computers, tablet devices, mobile telephones, PDAs, pagers, routers, switches, video game consoles, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices. Program modules for one entity can be located and/or run in another entities data center or "in the cloud."

Accordingly, in this specification and in the following claims, a computer system can also be defined to include traffic monitors (e.g., traffic sensors 134*a* and 134*b* in FIG. 2) and traffic signal controllers (e.g., traffic signal controller 131 in FIG. 2).

FIG. 1 depicts an example of a system 100 that can incorporate elements of the present invention. System 100 is exemplary only and does not show every element envisioned in every system. One skilled in the art will appreciate that system 100 can be modified and optimized based on the individual needs of the particular users. Furthermore, for clarity purposes, system 100 and the discussion related thereto are mostly directed herein to vehicles approaching a signalized intersection using a single approach (i.e., from a same direction). One skilled in the art will appreciate that system 100 can be modified to incorporate other approaches to the intersection and/or approaches to other intersections, as desired.

An operating environment for the devices of system 100 may comprise or utilize a processing system having one or more microprocessors and system memory. In accordance with the practices of persons skilled in the art of computer programming, embodiments of the present invention are described below with reference to acts and symbolic representations of operations or instructions that are performed by the processing system, unless indicated otherwise. Such acts and operations or instructions are referred to as being "computer-executed," "CPU-executed," or "processor-executed."

System 100 includes a traffic monitor 102, a computing device 104, and a user interface 106 that communicate with each other over a network 108. Traffic monitor 102 collects traffic data corresponding to a roadway approach to an intersection controlled by a traffic signal controller 110. Computing device 104 analyzes the collected traffic data to determine traffic patterns and possible ways to minimize or eliminate traffic congestion for the roadway approach. User interface 106 allows users to view the traffic data and corresponding analyses for the roadway approach. In some embodiments, user interface 106 can also allow users to perform further analysis, determine desired traffic signal timing changes for the roadway approach, and/or change the timing corresponding to the intervals of one or more of the traffic signal's phases. Network 108 can comprise one or more of a LAN, a WAN, the Internet, or any other type of network.

Traffic monitor 102 can comprise any traffic sensor that can detect and store information discussed below for vehicles that approach an intersection from a predetermined approach direction (i.e., along a particular roadway). Embodiments of the invention can include, but are not limited to, traffic sensors that are mounted above the roadway surface, monitor a wide portion of the roadway, and are robust to varying lighting and weather conditions. Traffic monitor 102 can also include electronic storage media to store the detected traffic information. The electronic storage media can comprise media, such as memory 112, within the traffic sensors. Alternatively, the electronic storage media can be positioned within a computing device electronically coupled to the traffic sensor.

By way of example and not limitation, traffic monitor 102 can detect and/or calculate some or all of the following information about each vehicle: the time that the vehicle passes one or more particular locations of the roadway; the speed of the vehicle at each location; the acceleration of the vehicle at each location; the lane of traffic in which the vehicle is positioned; the type of vehicle; etc. The vehicle information can be stored on memory 112 and subsequently transferred to computing device 104. Alternatively, the vehicle information can be transmitted in real-time or near real-time to computing device 104 to be stored thereon.

In many cases, traffic monitor 102 is synced with traffic signal controller 110 so that the information detected by traffic monitor 102 can be correlated with the corresponding phases and intervals of the traffic signal. In some cases, however, traffic monitor 102 may not be synced with traffic signal 110. In those cases, timing information can be obtained from traffic signal controller 110 by traffic monitor 102, by computing device 104, or by user interface 106, to sync the information detected by traffic monitor 102 to traffic signal controller 110. In some embodiments, syncing of the traffic sensor information with the traffic signal controller is not required and timing information is therefore not obtained.

Computing device 104 receives the traffic information from traffic monitor 102 and stores the information in a data structure, such as, e.g., one or more databases 114. Computing device 104 includes an analysis engine 116 that analyzes the received traffic data to determine platoon information discussed herein. Analysis engine 116 uses the platoon information to determine desired timing changes to make to intervals of traffic signal cycles corresponding to the approach direction that will reduce delays incurred by the vehicles in the platoon. This is discussed in more detail below. Analysis engine 116 can comprise one or more computer applications.

User interface 106 allows a user to view the traffic data and corresponding analysis performed by computing device 104. The information can be obtained by user interface 106 over network 108, as is known in the art. In some embodiments, user interface 106 can also allow a user to perform further analysis using the data and determine traffic signal timing for the roadway approach. In one embodiment, user interface 106 can electronically couple with traffic signal controller 110, either directly or through computing device 104, to allow the user to change the timing of phases and/or intervals of the traffic signal corresponding to the approach direction or to make any other desired changes to the traffic signal controller 110. This can be done over network 108 or another network. One or more applications can run on computing device 104 and/or user interface 106 to access and manipulate the data, as discussed in more detail below.

As noted above, system 100 is an exemplary system and various modifications can be made to it, as desired. For example, instead of having only a single traffic monitor 102, computing device 104, and user interface 106, system 100 can have more than one of any or all of those components. Furthermore, any or all of the system components can be combined, if desired. For example, analysis engine 116 and database 114 can be moved to traffic monitor 102, thereby merging computing device 104 into traffic monitor 102. As another example, user interface 106 can be moved to computing device 104 or to traffic monitor 102. If desired, all three components can be merged into a single computing unit. Furthermore traffic monitor 102, with or without any of the other system components, can be designed to be incorporated directly into the traffic signal controller 110 of the intersection.

In addition, traffic system 100 can be used for multiple intersection approaches and/or multiple intersections, if desired. For example, system 100 can include multiple traffic monitors 102 that feed traffic data from different intersection approaches and/or different intersections to computing device 104, which can store the information in the same or separate data structures. The user can then view and manage multiple approaches to an intersection and/or multiple intersections from user interface 106. As such, a coordinated analysis may be able to be performed on more than one intersection approach and/or more than one intersection. If desired, computing device 104 can comprise one or more servers of network 108 and user interface 106 can comprise one or more clients of network 108.

If desired, traffic system 100 can also be used by multiple users. For example, system 100 can include multiple user interfaces 106 for more user interaction with computing device 104. Other variations are also possible.

Figure 2A:
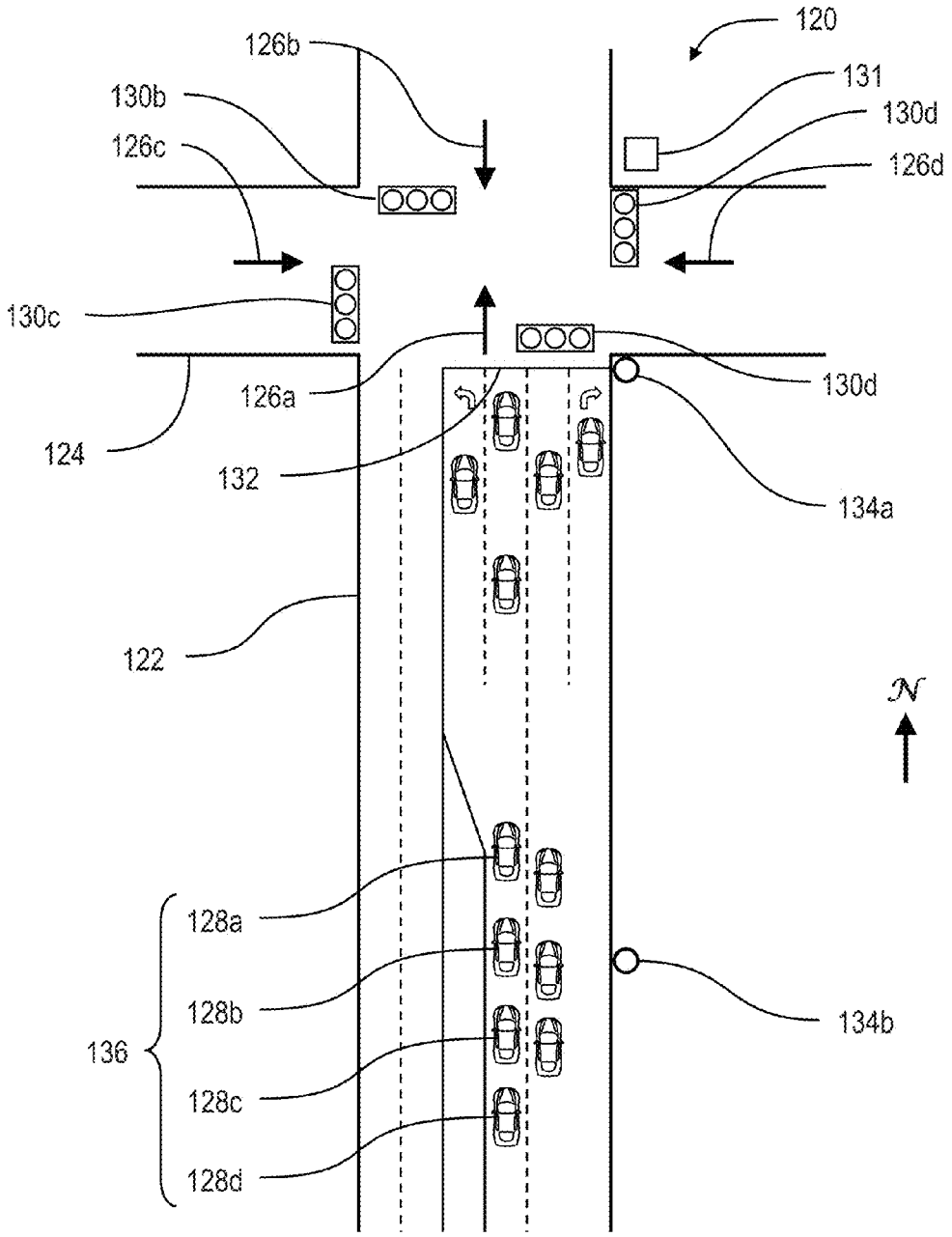
FIGS. 2A and 2B are top views of an example roadway intersection showing traffic detail of one approach to the intersection.
Figure 2B:
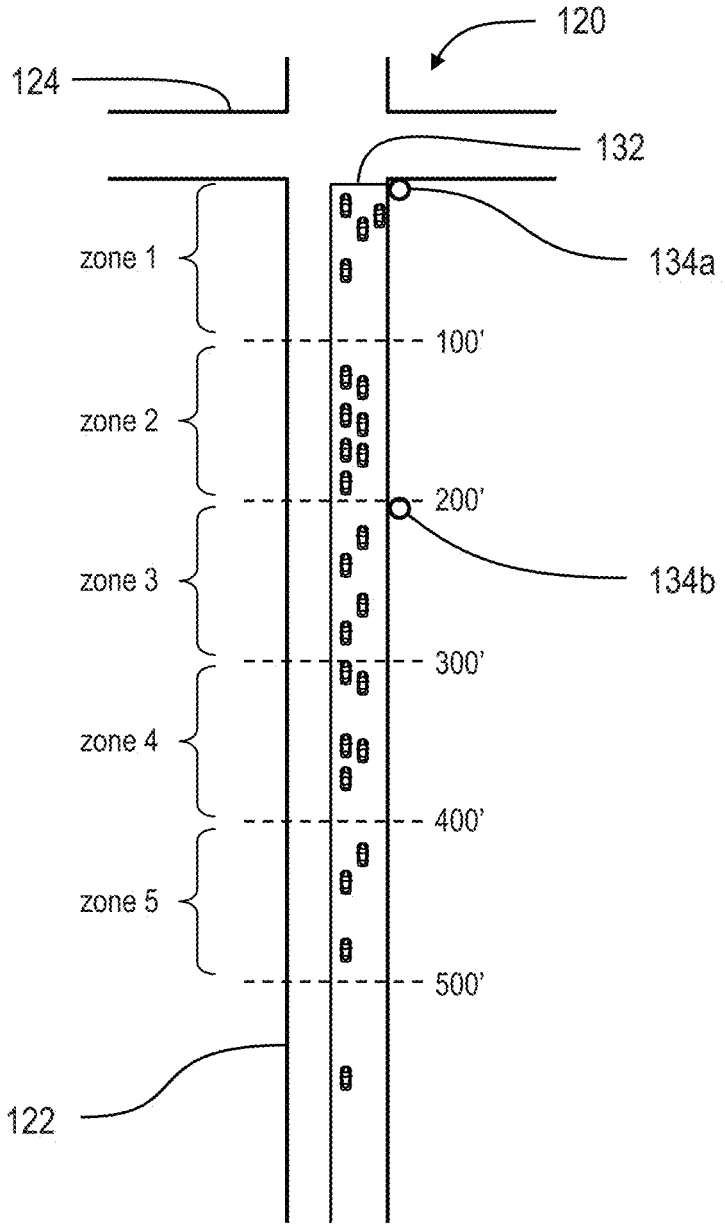

FIGS. 2A and 2B depict an example of a roadway intersection 120 in which two roadways 122 and 124 intersect. Intersection 120 will be used throughout the application in discussing various embodiments of the invention. It is appreciated that intersection 120 is exemplary only and that other types of intersections can also be used. For ease in discussion, roadways 122 and 124 respectively run North/South and East/West, although other directions are also possible. As such, intersection 120 has four different directions from which traffic can approach the intersection, denoted by arrows 126 (126*a-d*). Traffic from roadway 122 can enter intersection 120 from the south and from the north (directions 126*a* and 126*b*, respectively); traffic from roadway 124 can enter intersection 120 from the west and from the east (directions 126*c* and 126*d*, respectively). To simplify the discussion below, however, only the northbound approach to intersection 120 is depicted in detail with its northbound traffic.

One or more vehicles 128 can approach intersection 120 at any given time. To coordinate traffic entering intersection 120 from the various approach directions, one or more traffic signals 130 (130*a-d*) can be used, as is known in the art. Each traffic signal can include signal lights oriented toward one or more of the approach directions. Traffic signals 130 are controlled by a traffic signal controller 131 so that traffic can flow through intersection 120 in an orderly manner. Traffic signal controller 131 can correspond to traffic signal 110, discussed above.

Traffic signal controller 131 cycles the traffic signals 130 through the various phases of traffic at the intersection. In general, during each traffic cycle a traffic signal can include at least three signal indications corresponding to each approach toward which the traffic signal is oriented. In a first signal indication, the traffic signal controller causes a red signal light oriented toward the roadway approach to be illuminated on the traffic signal (i.e., the traffic signal "turns red"). This indicates to drivers of the corresponding approach that it is not safe to proceed through the intersection and to wait behind a stop line 132.

After the red signal light has been illuminated for a period of time, the traffic signal changes to a second signal indication in which the traffic signal controller causes a green signal light oriented toward the roadway approach to be illuminated on the traffic signal (i.e., the traffic signal "turns green"). This indicates to drivers of the corresponding approach that it is now safe to proceed through the intersection.

After the green signal light has been illuminated for a period of time, the traffic signal changes to a third signal indication in which the traffic signal controller causes a yellow signal light oriented toward the roadway approach to be illuminated on the signal controller (i.e., the traffic signal "turns yellow"). This indicates to drivers of the corresponding approach that the drivers should prepare to stop behind stop line 132. Because the first, second, and third signal indications respectively correspond to the red, green, and yellow signal lights being illuminated for a particular approach, these signal indications can also be respectively referred to as red, green, and yellow indications.

Finally, after the yellow signal light has been illuminated for a period of time, the traffic signal controller returns the signal to the red indication to begin a new cycle corresponding to the particular approach. Other signal indications may also be present in a cycle for one or more of the roadway approaches, such as indications for turning lanes, etc.

Although traffic signals 130 combine to include signal indications oriented to each approach to the intersection, for simplicity purposes the discussion of signal indications herein will only be directed to the signal indications oriented toward a single movement at the intersection (e.g., the northbound through movement at intersection 120) unless specifically noted otherwise. Thus, discussion of traffic signals turning red, yellow, or green herein is meant to apply to the signal indications that are oriented toward the applicable approach. Similarly, discussion of a traffic signal cycle is meant to apply with respect to the applicable approach.

The traffic signal cycle can begin at any time during any of the signal indications, as long as each cycle begins at the same relative time. For example, a traffic signal cycle can begin each time the traffic signal turns green or yellow, or red if desired. In the discussion below, however, each traffic signal cycle will be considered to start when the traffic signal turns red to simplify the discussion.

As noted above, traffic signal controller 131 controls traffic signals 130 so that the traffic signals cycle through the various phases at different times to allow traffic to safely flow through intersection 120. The timing of the phases with respect to each other, as well as the duration of time each traffic signal light is illuminated in each phase can be varied to aid in traffic flow. In addition, the timing of phases at successive intersections along a roadway can be coordinated and varied to aid in traffic flow along a traffic corridor.

To help determine desired variations, one or more traffic sensors can be used. The traffic sensors can determine the amount of traffic flowing through the intersection over a period of time so that the timing of the phases, the phase lengths, and/or each signal indication portion thereof can be modified for one or more of the traffic signals.

For example, the depicted embodiment includes a pair of traffic sensors 134 (134*a-b*) that can be used to determine the amount of traffic approaching intersection 120 from the south. Either or both of traffic sensors 134*a-b* can correspond to traffic monitor 102, discussed above. Each traffic sensor 134 may determine one or more of the following: the number of vehicles that pass thereby in a given amount of time, the speed of each vehicle, the direction of each vehicle, etc. Some advanced traffic sensors can also determine the number of vehicles that pass through a given zone (i.e., a length of the roadway) within a given period of time. One or more of these advanced sensors can give coverage of the entire approach, if desired, and can provide multiple data sets for each cycle of the traffic signal.

For example, if traffic sensor 134*b* is capable of monitoring traffic in 100-foot road lengths, traffic sensor 134*b* can be positioned to monitor traffic in the 100-foot zone 3 that spans between 200 and 300 feet from stop line 132 as shown in FIG. 1B. If four other similar traffic sensors 134*b* are positioned to monitor traffic in the other 100 foot zones between stop line 132 and 500 feet, (i.e., zones 1, 2, 4, and 5) then the entire approach is covered up to 500 feet from the intersection. 100-foot zone lengths is exemplary only; other zone lengths can also be used. In addition, the length of each zone can be the same, or one or more of the zones can be of a different length than the others. Furthermore, each zone can cover all of the lanes of traffic within the particular road length or separate zones can be set up to cover separate lanes of traffic along the roadway, with the zones corresponding to the different lanes being the same or different lengths.

In some embodiments, traffic sensors 134*b* can be used that do not cover the entire length of the zone. While the sensed traffic may not be complete, the data can still be useful to determine ways in which to improve traffic using the present invention. One example of a traffic sensor that can be used as traffic sensor 134*b* is a SmartSensor Matrix, manufactured by Wavetronix, LLC of Provo, Utah ("Wavetronix"). The SmartSensor Matrix can monitor zones of roadway traffic looking both across the roadway and along the roadway.

In one embodiment, traffic sensor 134 can monitor traffic for a greater area of the approach, thereby alleviating the need for multiple traffic sensors to cover the intersection approach. One example of such a traffic sensor is a SmartSensor Advance, also manufactured by Wavetronix, which can be positioned at or near stop line 132 and can monitor traffic between the stop line and up to 900 feet away. In addition, the SmartSensor Advance can concurrently monitor different zones within the 900 foot range to provide multiple data sets. As such, a single SmartSensor Advance may be used as traffic sensor 134*a*, instead of multiple sensors 134*b*, to concurrently monitor multiple zones and yield the same amount of data. The SmartSensor Advance can also determine the speed of the vehicle as the vehicle approaches the intersection. Other sensors from Wavetronix and other manufacturers can also be used.

Although traffic signals 130 allow for the safe passage of traffic through intersection 120, the traffic signals can also be a bottleneck for traffic that must slow down or stop, especially if intersection 120 is a heavily used intersection. This problem can be minimized or even alleviated if the timing of the signal lights can be set so that platoons of vehicles can proceed through intersection 120 without interference.

As noted above, a platoon is a group of vehicles that remain closely bunched together as the vehicles travel along a roadway. Typically, a platoon initially forms when vehicles approach a signalized intersection and must stop and wait for the traffic signal to turn green, thereby forming a queue. Once the traffic signal turns green, the cars tend to travel along the roadway bunched together as a platoon. The longest platoons tend to form when the queue is formed at the phase with heaviest volume, typically the through phase, of the intersection. Once formed, the vehicles in the platoon tend to remain closely bunched together as they approach downstream intersections.

Platoons can also be formed in other manners not related to the queuing up of vehicles at an intersection. However, those platoons tend to be much smaller and are difficult to plan for; therefore, embodiments of the present invention are designed to differentiate, at a downstream intersection, those other platoons from platoons that are formed by queuing at a coordinated phase of an upstream intersection so that the traffic analysis is more accurate. For clarity purposes, a platoon that formed at a coordinated phase of an upstream intersection and is now approaching or passing through a subsequent intersection will be referred to herein as an "upstream platoon" with respect to the subsequent intersection.

Platoons of vehicles can be desirable because they allow vehicles to efficiently travel along a roadway while maintaining a maximum capacity for the roadway. However, if a platoon encounters interference (i.e., is forced to slow down or stop), the advantage can turn into a disadvantage, as discussed below. For this reason, once a platoon forms at a first intersection of a corridor of intersections on a main thoroughfare, it is generally desirable to allow the upstream platoon to travel along the thoroughfare through each subsequent intersection without having to stop or slow down. This preserves the advantages of the platoon while avoiding the disadvantages.

For purposes of this application, each vehicle in a platoon may experience no interference, "soft" interference, or "hard" interference. A vehicle in a platoon is said to experience soft interference when the vehicle is forced to substantially reduce speed (i.e., slow down). A vehicle in the platoon is said to experience hard interference when the vehicle is forced to come to a complete stop or to almost come to a stop (e.g., 5 mph or less). A vehicle in the platoon is said to experience no interference when the speed of the vehicle has not been substantially impacted.

Also for purposes of this application, the type of interference experienced by the platoon may be defined as "lower" or "upper" interference. A platoon is said to experience lower interference when the first or lead vehicle of the platoon experiences soft or hard interference. Lower interference is experienced when a platoon arrives at a signalized intersection before the traffic signal turns green or when a standing queue at the intersection has not cleared out of the intersection by the time the platoon arrives.

A platoon is said to experience upper interference when the last or trail vehicle of the platoon experiences soft or hard interference. Upper interference is experienced when the traffic signal turns red before the last vehicles in a platoon have been able to enter the intersection. Lower and upper interface may also be experienced at other times.

Once a platoon has been slowed, a longer time period is generally required to increase the speed of the slowed platoon due to the closeness of the vehicles to each other. That is, once the lead vehicle of the platoon begins to accelerate, a finite amount of time passes before the second vehicle in the platoon can begin to accelerate. The next vehicle must wait a finite time from the acceleration of the second vehicle, and so forth. As a result, each vehicle in the platoon adds an additional finite amount of time before the next vehicle in line can accelerate. As such, the time required for the last vehicle in the platoon to begin accelerating equals the aggregate of all of the amounts of time required for each vehicle ahead of the last vehicle. This can lead to a significant delay, especially if the platoon is large and/or the platoon is caused to slow down often, such as at each intersection the platoon encounters.

For example, in the depicted embodiment, vehicles 128*a-d* form a platoon 136, with vehicles 128*a* and 128*d* respectively being the lead and trail vehicles in the platoon. Assuming, for example, that, due to the closeness of the vehicles, one second is required between vehicles for each vehicle to be able to begin to accelerate, then vehicle 128*b* will begin accelerating one second after lead vehicle 128*a* begins to accelerate; vehicle 128*c* will begin accelerating one second after vehicle 128*b* begins to accelerate; and vehicle 128*d* will begin accelerating one second after vehicle 128*c* begins to accelerate. As such, trail vehicle 128*d* will not even begin to accelerate until three seconds after lead vehicle 128*a* begins to accelerate.

In a large platoon, such as one formed at an upstream intersection (i.e., an upstream platoon), this can lead to a significant delay, especially if the platoon is caused to slow down or stop at each signalized intersection. This can also lead to significant traffic congestion at a heavily-used intersection, especially if a different platoon encounters interference during each cycle of the traffic signal. In light of the above, to alleviate traffic congestion, a major goal of traffic engineers is to reduce interference to large upstream platoons of traffic by allowing the upstream platoons to flow through a corridor of signalized intersections unimpeded.

Figure 3:
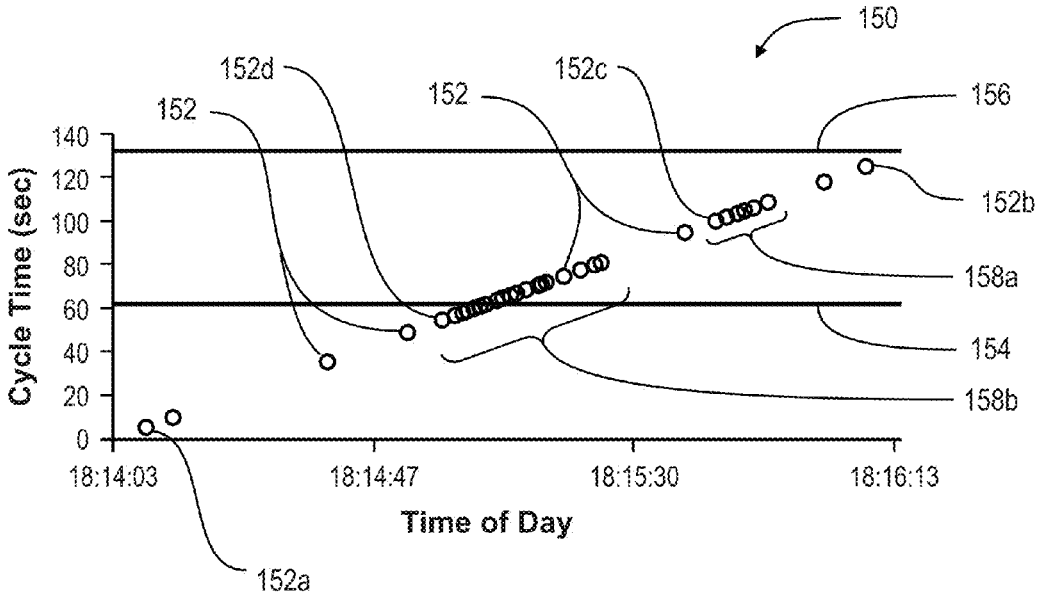
FIG. 3 depicts an example of a single-cycle Purdue Coordination Diagram.

To help visualize traffic flow through intersection 120, a diagram can be used for each approach direction that plots the time and position within the traffic signal cycle that each vehicle 128 arrives at the intersection. An example of one such diagram, known as a Purdue Coordination Diagram (PCD), is shown in FIG. 3 and will be identified herein as PCD 150. In PCD 150, the time that each vehicle arrived at intersection 120 from a particular approach direction is plotted for a single cycle of a traffic signal. In PCD 150, the x-axis represents the time of day and the y-axis represents the time, in seconds, within the cycle. In PCD 150, the cycle began when the traffic signal turned red. However, as discussed above, the cycle can begin at any time.

Each data point 152 within the diagram represents an estimated or actual arrival time of an individual vehicle at the intersection stop bar. Data point 152*a* on the lower left of PCD 150 represents the first vehicle to arrive at the intersection during the cycle while data point 152*b* on the upper right of PCD 150 represents the last vehicle to arrive at the intersection during the cycle.

PCD 150 also includes two horizontal lines 154 and 156 extending from the y-axis. Horizontal lines 154 and 156 indicate the time within the cycle that the traffic signal respectively turned green and red; as such, they will be referred to herein as "go" line 154 and "stop" line 156. In a colored version of the diagram, lines 154 and 156 can be colored green and red for easy visualization. "Go" and "stop" lines 154 and 156 indicate that the traffic signal associated with PCD 150 turned green at about 60 seconds into the cycle and turned red at about 130 seconds into the cycle, as evidenced by the cycle-time values of the lines. That is, the traffic signal was red until about 60 seconds and green (and yellow) thereafter until about 130 seconds.

If desired, a similar line can be included in the PCD indicating the time within the cycle that the traffic signal turned yellow, although it has been found that the yellow line can be omitted for most uses. Because the cycle began when the traffic signal turned red (at time 0), the cycle ended when the traffic signal again turned red (at about time 130). Thus, in PCD 150 the cycle lasted about 130 seconds and ended at "stop" line 156.

In light of the above, data points 152 plotted below "go" line 154 represent vehicles that arrived at the intersection while the traffic signal was red (i.e., before the traffic signal turned green) and data points 152 above "go" line 154 represent vehicles that arrived at the intersection after the traffic signal turned green.

A PCD can visually convey useful information regarding the traffic arriving at the intersection from the corresponding approach direction. For example, from PCD 150 a traffic engineer can visually determine that approximately thirty-five vehicles arrived at intersection 120 during the cycle, with the majority of those vehicles (about twenty) arriving within about twenty seconds before and after the traffic signal turned green. In addition, two possible platoons, represented by data clusters 158 (158*a*-*b*) appear to have passed through intersection 120 during the cycle. Although data cluster 158*a* is smaller than data cluster 158*b*, it is not readily clear which of the data clusters may represent an upstream platoon.

All of the data points 152 corresponding to data cluster 158*a* are above "go" line 154, signifying that the vehicles of the platoon represented by data cluster 158*a*, including the lead vehicle represented by data point 152*c*, arrived at intersection 120 while the traffic signal was green. As such, the vehicles of the corresponding platoon appear to have passed through the intersection without experiencing any interference caused by the timing of the traffic signal.

On the other hand, some of the data points 152 corresponding to the platoon represented by data cluster 158*b* are below "go" line 154 and some are above "go" line 154. This signifies that some of the vehicles of the corresponding platoon, including the lead vehicle represented by data point 152*d*, arrived at intersection 120 before the traffic signal turned green and some arrived after the traffic signal turned green. It is assumed (but not known) that those vehicles that arrived before the traffic signal turned green were forced to slow down and possibly stop to wait for the traffic signal. Thus, the timing of the traffic signal is presumed to have caused the platoon to experience lower platoon interference, although the traffic engineer cannot be sure.

Figure 4:
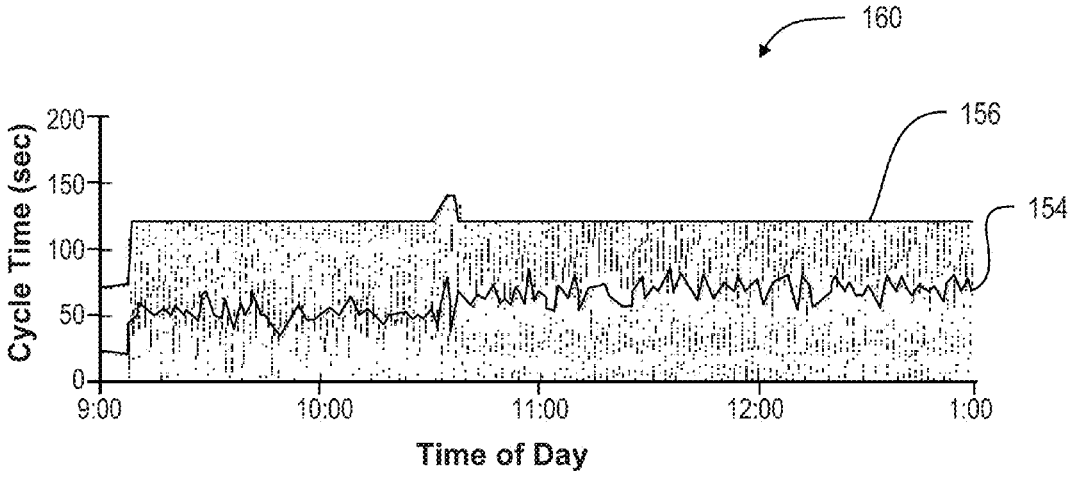
FIG. 4 depicts an example of a multi-cycle Purdue Coordination Diagram.

To determine trends at intersection 120, a multi-cycle PCD can be generated that plots the above information for a consecutive series of traffic signal cycles for an approach to intersection 120. For example, FIG. 4 depicts an example of a multi-cycle PCD 160 that plots the position of each vehicle within a series of consecutive cycles that together cover a period of about four hours. As can be seen from multi-cycle PCD 160, each cycle lasted about 130 seconds; because PCD 160 covers about a four-hour period, PCD 160 shows information for about 130 consecutive cycles. To accommodate all 130 cycles on a single diagram, the data for each cycle is horizontally compressed compared to single-cycle PCD 150. As such, the data for each cycle is almost-vertically represented.

Multi-cycle PCD 160 can visually give a wealth of information about traffic trends at intersection 120 that can be used by a traffic engineer to determine what, if any, modifications might help alleviate traffic problems. From multi-cycle PCD 160, the traffic engineer can visually estimate whether timing modifications of the traffic signal would likely help alleviate traffic problems at the intersection and when during the day the timing modifications would likely be most helpful.

For example, it appears from PCD 160 that from 9:00 to about 10:40, platoons tend to arrive at the intersection before the traffic signal turns green, presumably causing the platoons to experience lower interference, similar to platoon 158*b* of PCD 150. As such, the traffic engineer can estimate that modifying the traffic signal timing so that the traffic signal turns green a little sooner in the cycle might alleviate the lower interference to platoons in the future. However, as discussed above, the timing of the traffic signal is only presumed to have caused the platoon to experience lower platoon interference; if no interference was experienced, the traffic signal timing modifications may not be needed.

The traffic engineer can also visually determine from PCD 160 that after about 10:40, the platoons are arriving at the intersection after the traffic signal has already turned green, similar to platoon 158*a* of PCD 150. This indicates that during this time period the signal timing may be close to optimal for the corridor as the platoons are able to enter and pass through the intersection unimpeded.

As noted above, a key factor in alleviating traffic congestion is the reduction or elimination of interference to upstream platoons. Although a traffic engineer can deduce much traffic information about an intersection approach by viewing a multi-cycle PCD, the multi-cycle PCD has some shortcomings, especially regarding platoons. For example, a multi-cycle PCD does not specifically differentiate between platoon versus non-platoon traffic; it is left up to the traffic engineer to visually identify clusters within the PCD that might be platoons. This can be very challenging; it may not be clear from viewing the multi-cycle PCD when platoons are present due to the many data points and spaces therebetween. This is certainly the case in multi-cycle PCD 160.

Furthermore, a traffic engineer may find more than one cluster in any particular cycle that may appear to be separate platoons, even though the clusters are actually two portions of a single upstream platoon. In addition, even if an upstream platoon is correctly identified, it can only be presumed (and not known) that the platoon is experiencing interference, as discussed above. If an error is made in the determination of platoons or interference that may or may not have been experienced by the platoons, it could negatively impact proposed solutions, as those solutions would be based on erroneous observations.

Furthermore, even if an upstream platoon that was experiencing interference can be visually determined using a multi-cycle PCD, the impact that the interference to the platoon had on the vehicles that made up the platoon is not obvious from the multi-cycle PCD. For example, a traffic engineer may not be able to clearly determine from multi-cycle PCD 160 how many, if any, vehicles of any platoon were forced to slow down (soft interference) or stop (hard interference) or, as noted above, may not even notice if any interference occurred.

Furthermore, the position within the platoon where interference occurred is not obvious from a multi-cycle PCD. For example, a traffic engineer may not be able to clearly determine from multi-cycle PCD 160 whether interference was experienced at the head of the platoon or the tail of the platoon or both. Yet, if the type and position of interference were known, potential solutions to the traffic congestion encountered by the upstream platoon could be tailored to solve the particular problem. These solutions would therefore be more accurate, resulting in smoother traffic flow.

Finally, although the data that is used to generate the multi-cycle PCD could be used to quantify total vehicle counts, arrival on red counts, and arrival on green counts, it cannot be used to quantify performance based on platoons and interference to platoons.

To alleviate the above shortcomings of the conventional PCD, and to provide further traffic analysis and congestion relief, systems and methods for generating an Enhanced Platoon Coordination Diagram (EPCD) are presented and discussed herein. The EPCD can provide similar information as a PCD as well as additional information that can help a traffic engineer prevent and/or alleviate traffic congestion. The EPCD is generated using vehicle location and speed data obtained from traffic sensors to definitively determine the start and end of each significant platoon, the type of interference experienced by the platoon and the location of the interference within the platoon. From this additional data, a more accurate traffic picture can be obtained so that solutions to traffic congestion can be more easily identified and implemented.

To aid in the discussion of the methods below, it will be assumed that five streams of data were concurrently recorded each second by traffic monitor 102. Each recorded stream of data corresponds to a separate one of the five 100-foot zones (zones 1-5) shown in FIG. 2B. Of course, as noted above, other sizes and types of zones can also be used. In addition, other lengths of time between recordings can also be used. For example, the length of time between recordings can be more or less than one second. A single traffic sensor 134*a* that recorded all five streams, such as, e.g., a SmartSensor Advance discussed above, can be used to accomplish this. Alternatively, separate traffic sensors 134*b* that each record a separate one of the different zones 1-5, such as, e.g., a SmartSensor Matrix, discussed above, can be used. It will be appreciated that if only one zone is used or if other numbers of concurrent zone recordings are used, the methods can be adapted accordingly. In general, however, data corresponding to more than one zone will produce more accurate results because more data sets can be used. In addition, interpolation algorithms can benefit by extrapolating trends from nearby zones and sensor noise can be reduced using filtering algorithms that take this into account. Table 1 shows sample data obtained during a single cycle for the five recorded zones.

TABLE 1

| Time of | Cycle | | Average Velocity in Zone | | | | |
|---|---|---|---|---|---|---|---|
| Day | Time (sec) | Phase | 5 | 4 | 3 | 2 | 1 |
| 8:21:00 | 0 | Red | 0 | 0 | 0 | 0 | 0 |
| 8:21:01 | 1 | Red | 0 | 0 | 0 | 0 | 0 |
| 8:21:02 | 2 | Red | 0 | 0 | 0 | 0 | 0 |
| 8:21:03 | 3 | Red | 0 | 0 | 0 | 0 | 0 |
| 8:21:04 | 4 | Red | 0 | 0 | 0 | 0 | 0 |

TABLE 1-continued

| Time of | Cycle | | Average Velocity in Zone | | | | |
|---|---|---|---|---|---|---|---|
| Day | Time (sec) | Phase | 5 | 4 | 3 | 2 | 1 |
| 8:21:05 | 5 | Red | 0 | 0 | 0 | 0 | 0 |
| 8:21:06 | 6 | Red | 0 | 0 | 0 | 0 | 0 |
| 8:21:07 | 7 | Red | 0 | 0 | 0 | 0 | 10 |
| 8:21:08 | 8 | Red | 0 | 0 | 0 | 0 | 10 |
| 8:21:09 | 9 | Red | 0 | 0 | 0 | 0 | 0 |
| 8:21:10 | 10 | Red | 0 | 0 | 0 | 0 | 0 |
| 8:21:11 | 11 | Red | 0 | 0 | 0 | 0 | 0 |
| 8:21:12 | 12 | Red | 41 | 0 | 0 | 0 | 0 |
| 8:21:13 | 13 | Red | 0 | 0 | 0 | 0 | 0 |
| 8:21:14 | 14 | Red | 0 | 35 | 0 | 0 | 0 |
| 8:21:15 | 15 | Red | 0 | 0 | 0 | 0 | 0 |
| 8:21:16 | 16 | Red | 0 | 0 | 28 | 0 | 0 |
| 8:21:17 | 17 | Red | 0 | 0 | 28 | 0 | 0 |
| 8:21:18 | 18 | Red | 0 | 15 | 0 | 16 | 0 |
| 8:21:19 | 19 | Red | 0 | 15 | 0 | 16 | 0 |
| 8:21:20 | 20 | Red | 0 | 0 | 0 | 16 | 0 |
| 8:21:21 | 21 | Red | 0 | 0 | 0 | 0 | 0 |
| 8:21:22 | 22 | Red | 0 | 0 | 0 | 2 | 0 |
| 8:21:23 | 23 | Red | 0 | 0 | 0 | 0 | 0 |
| 8:21:24 | 24 | Red | 0 | 0 | 0 | 0 | 0 |
| 8:21:25 | 25 | Red | 0 | 0 | 0 | 0 | 0 |
| 8:21:26 | 26 | Red | 60 | 0 | 0 | 0 | 0 |
| 8:21:27 | 27 | Red | 0 | 37 | 0 | 0 | 0 |
| 8:21:28 | 28 | Red | 0 | 37 | 0 | 0 | 0 |
| 8:21:29 | 29 | Red | 0 | 38 | 29 | 0 | 0 |
| 8:21:30 | 30 | Red | 0 | 0 | 34 | 0 | 0 |
| 8:21:31 | 31 | Red | 0 | 0 | 0 | 29 | 0 |
| 8:21:32 | 32 | Red | 48 | 0 | 0 | 20 | 0 |
| 8:21:33 | 33 | Red | 0 | 38 | 0 | 11 | 0 |
| 8:21:34 | 34 | Red | 45 | 38 | 0 | 11 | 0 |
| 8:21:35 | 35 | Red | 35 | 41 | 33 | 11 | 0 |
| 8:21:36 | 36 | Red | 36 | 45 | 33 | 11 | 0 |
| 8:21:37 | 37 | Red | 31 | 28 | 37 | 16 | 0 |
| 8:21:38 | 38 | Red | 0 | 29 | 33 | 20 | 0 |
| 8:21:39 | 39 | Red | 0 | 17 | 23 | 28 | 0 |
| 8:21:40 | 40 | Red | 41 | 4 | 25 | 17 | 0 |
| 8:21:41 | 41 | Red | 30 | 23 | 25 | 17 | 0 |
| 8:21:42 | 42 | Red | 21 | 27 | 21 | 14 | 0 |
| 8:21:43 | 43 | Red | 28 | 25 | 21 | 10 | 0 |
| 8:21:44 | 44 | Green | 36 | 22 | 22 | 10 | 15 |
| 8:21:45 | 45 | Green | 0 | 24 | 21 | 8 | 15 |
| 8:21:46 | 46 | Green | 38 | 24 | 21 | 8 | 15 |
| 8:21:47 | 47 | Green | 37 | 24 | 15 | 12 | 15 |
| 8:21:48 | 48 | Green | 45 | 24 | 15 | 13 | 0 |
| 8:21:49 | 49 | Green | 14 | 31 | 12 | 14 | 23 |
| 8:21:50 | 50 | Green | 14 | 30 | 16 | 14 | 23 |
| 8:21:51 | 51 | Green | 41 | 18 | 19 | 13 | 23 |
| 8:21:52 | 52 | Green | 41 | 17 | 18 | 30 | 23 |
| 8:21:53 | 53 | Green | 35 | 22 | 0 | 20 | 23 |
| 8:21:54 | 54 | Green | 34 | 25 | 16 | 14 | 26 |
| 8:21:55 | 55 | Green | 0 | 35 | 19 | 14 | 28 |
| 8:21:56 | 56 | Green | 0 | 35 | 23 | 14 | 28 |
| 8:21:57 | 57 | Green | 0 | 0 | 30 | 16 | 0 |
| 8:21:58 | 58 | Green | 39 | 0 | 33 | 19 | 33 |
| 8:21:59 | 59 | Green | 39 | 0 | 0 | 26 | 20 |
| 8:22:00 | 60 | Green | 0 | 43 | 0 | 28 | 21 |
| 8:22:01 | 61 | Green | 0 | 0 | 33 | 15 | 26 |
| 8:22:02 | 62 | Green | 0 | 0 | 35 | 15 | 26 |
| 8:22:03 | 63 | Green | 0 | 0 | 0 | 37 | 25 |
| 8:22:04 | 64 | Green | 0 | 0 | 0 | 37 | 26 |
| 8:22:05 | 65 | Green | 0 | 8 | 0 | 0 | 34 |
| 8:22:06 | 66 | Green | 0 | 0 | 0 | 0 | 35 |
| 8:22:07 | 67 | Green | 0 | 0 | 0 | 0 | 0 |
| 8:22:08 | 68 | Green | 0 | 0 | 0 | 0 | 0 |
| 8:22:09 | 69 | Green | 0 | 0 | 0 | 0 | 0 |
| 8:22:10 | 70 | Green | 0 | 0 | 0 | 0 | 0 |
| 8:22:11 | 71 | Green | 0 | 0 | 0 | 0 | 0 |
| 8:22:12 | 72 | Green | 48 | 0 | 0 | 0 | 0 |
| 8:22:13 | 73 | Green | 0 | 46 | 0 | 0 | 0 |
| 8:22:14 | 74 | Green | 0 | 0 | 0 | 0 | 0 |
| 8:22:15 | 75 | Green | 0 | 0 | 46 | 0 | 0 |
| 8:22:16 | 76 | Green | 0 | 0 | 0 | 43 | 0 |
| 8:22:17 | 77 | Green | 43 | 0 | 0 | 43 | 0 |
| 8:22:18 | 78 | Green | 43 | 0 | 0 | 0 | 44 |
| 8:22:19 | 79 | Green | 0 | 45 | 0 | 0 | 0 |
| 8:22:20 | 80 | Green | 43 | 0 | 41 | 0 | 0 |

TABLE 1-continued

| Time of Day | Cycle Time (sec) | Phase | Average Velocity in Zone 5 | 4 | 3 | 2 | 1 |
|---|---|---|---|---|---|---|---|
| 8:22:21 | 81 | Green | 43 | 0 | 41 | 0 | 0 |
| 8:22:22 | 82 | Green | 48 | 53 | 0 | 41 | 0 |
| 8:22:23 | 83 | Green | 38 | 38 | 43 | 0 | 37 |
| 8:22:24 | 84 | Green | 38 | 38 | 0 | 0 | 0 |
| 8:22:25 | 85 | Green | 36 | 36 | 41 | 43 | 0 |
| 8:22:26 | 86 | Green | 36 | 36 | 0 | 42 | 48 |
| 8:22:27 | 87 | Green | 0 | 33 | 40 | 42 | 0 |
| 8:22:28 | 88 | Green | 0 | 33 | 0 | 36 | 42 |
| 8:22:29 | 89 | Green | 0 | 0 | 32 | 0 | 42 |
| 8:22:30 | 90 | Green | 0 | 0 | 32 | 0 | 0 |
| 8:22:31 | 91 | Green | 0 | 0 | 0 | 24 | 0 |
| 8:22:32 | 92 | Green | 0 | 0 | 0 | 24 | 31 |
| 8:22:33 | 93 | Green | 0 | 0 | 0 | 24 | 0 |
| 8:22:34 | 94 | Green | 0 | 0 | 0 | 0 | 0 |
| 8:22:35 | 95 | Green | 0 | 0 | 0 | 0 | 0 |
| 8:22:36 | 96 | Green | 0 | 0 | 0 | 0 | 0 |
| 8:22:37 | 97 | Green | 0 | 0 | 0 | 0 | 0 |

For each time period, (in this case, each second) of the cycle, Table 1 shows the average velocity of the vehicles detected in each zone and the corresponding indication of the traffic signal. As noted above, zones 1-5 of Table 1 correspond to the 100-foot zones shown in FIG. 2B. Thus, at cycle time 7, for example, the "10" in the rightmost cell signifies that during that time of the cycle, vehicular traffic was detected in zone 1 having an average velocity of 10 mph. This could represent a single vehicle or multiple vehicles within the zone; the velocity in each cell is simply an average velocity of all detected traffic in that zone for the particular time period. As such, a count of the number of vehicles is not required to generate Table 1. A zero in a cell means that no vehicular traffic was detected or that the traffic was stopped in that zone for that time period. In some embodiments, a differentiation can be made between the two, if desired.

Table 1 indicates that the length of the cycle was 98 time periods (e.g., seconds) and the traffic signal turned green 44 time periods (e.g., seconds) into the cycle. As shown in Table 1, the first traffic detected in the cycle was in zone 1 at cycle time 7, where a velocity of 10 mph is shown. This traffic was only detected for two seconds, as the velocity shown in zone 1 at cycle time 9 returned to zero. This is likely not representative of normal traffic approaching the intersection but may have been caused by a vehicle turning into the lane of traffic from a parking lot near the intersection and then stopping or turning at the intersection.

A more typical representation of traffic approaching a red light is shown starting at cycle time 12 where the traffic, probably a single vehicle, was detected in zone 5. As time progresses, the traffic moves closer to the intersection (i.e., from zone 5 toward zone 1) and the detected velocities decrease to zero by the time the traffic has arrived at the intersection at cycle time 19.

In contrast, a typical representation of traffic approaching a green light is shown starting at cycle time 72 where the traffic, again probably a single vehicle, was detected in zone 5. As time progresses, the traffic again moves closer to the intersection but in this case, the detected velocities only decrease a little (from 48 to 44 mph) by the time the traffic has arrived at the intersection at cycle time 78.

Table 1 indicates that traffic was detected in almost all of the zones from about cycle time 35 to cycle time 54, reflecting a significant amount of traffic on the roadway. This may or may not have constituted a platoon.

Figure 5:
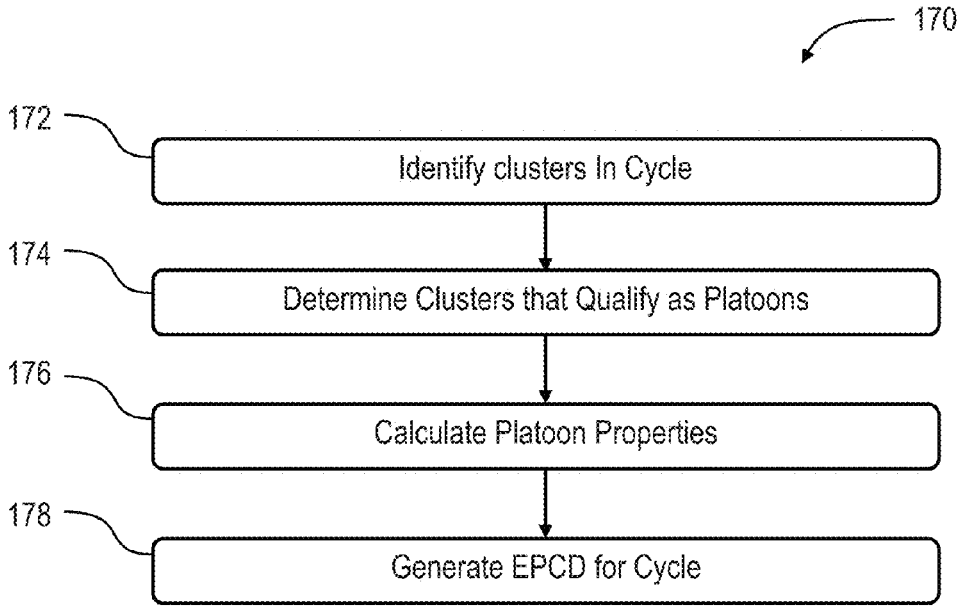
FIG. 5 illustrates a method of determining platoon information corresponding to a single cycle of a traffic signal according to one embodiment.

With the foregoing in mind, FIG. 5 illustrates a method 170 of improving traffic flow by analyzing traffic information obtained from traffic monitor 102 corresponding to a cycle of a traffic signal, according to one embodiment. Method 170 can be performed at computing device 104 as a part of analysis engine 116 (FIG. 1). All or portions of method 170 can alternatively be performed at traffic monitor 102, user interface 106, or at any combination of traffic monitor 102, computing device 104, and user interface 106, or any other processing device or combination thereof.

In step 172, clusters are identified in the cycle. In one embodiment, a Density-Based Spatial Clustering of Applications with Noise (DBSCAN) algorithm can be used. DBSCAN is a computerized data clustering algorithm known by those in the computer arts. In general, DBSCAN's definition of a cluster is based on the notion of density reachability. Basically, a point q is directly density-reachable from a point p if point q is not farther away from point p than a given distance $\epsilon$ (i.e., is part of its $\epsilon$-neighborhood) and if p is surrounded by sufficiently many points such that one may consider p and q to be part of a cluster. DBSCAN requires two parameters: $\epsilon$ and the minimum number of points required to form a cluster. As DBSCAN is already known in the computer arts, a detailed discussion of the algorithm is omitted herein.

Figure 6:
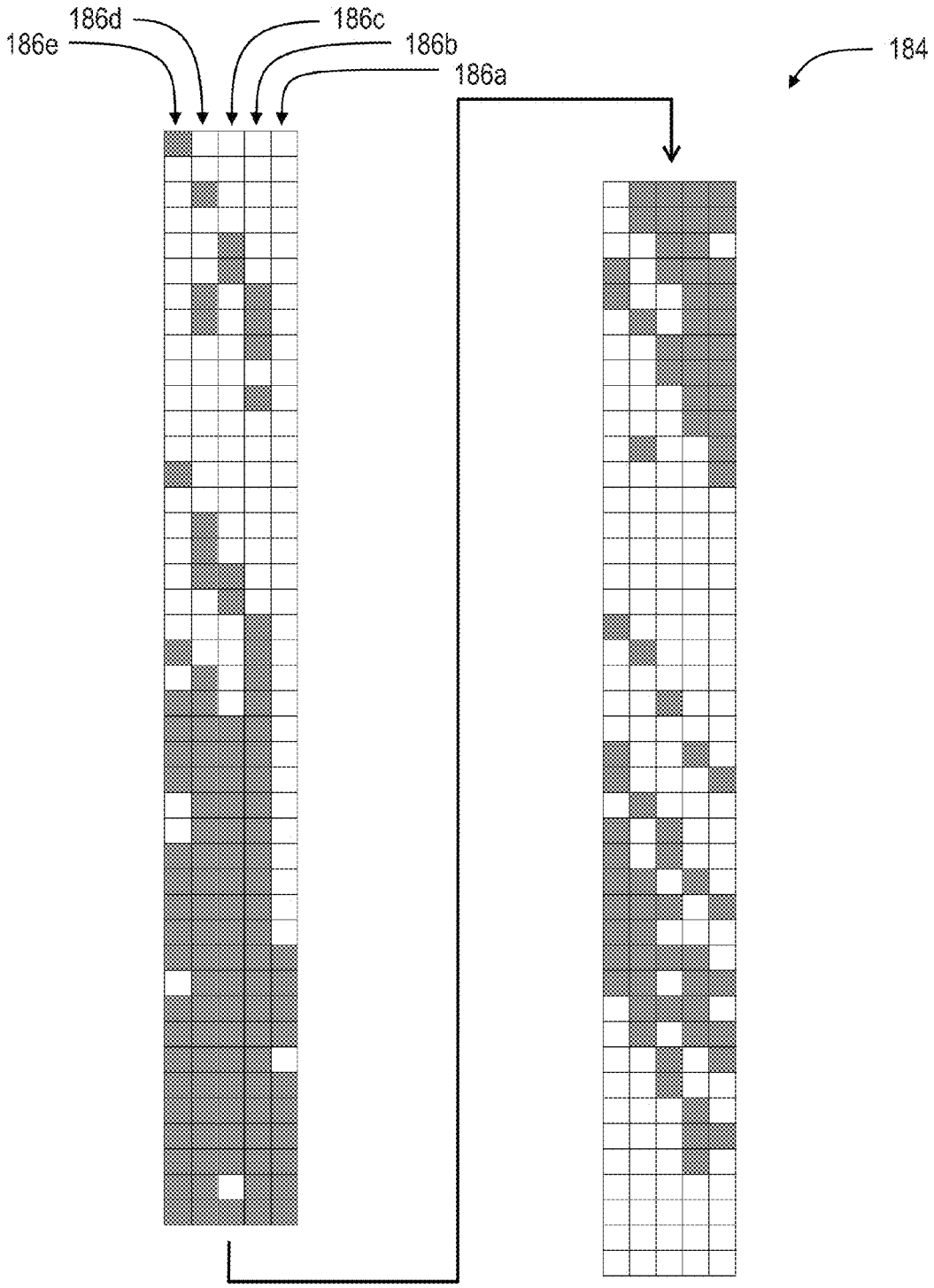
FIG. 6 is a visual representation of a portion of a DBSCAN grid.

In one embodiment, DBSCAN was performed using a grid based on the spreadsheet shown in Table 1. FIG. 6 is a visual representation of a portion 184 of the DBSCAN grid. In grid 184, zones 1-5 are represented by columns 186*a-e*, respectively, and the rows correspond to the cycle times. To normalize values across grid 184, the data for zones 2-5 can be shifted down in the grid with respect to Table 1, if desired, so that the data in each row across grid 184 can generally correspond to the same vehicle(s). For example, the data for zones 2-5 (columns 186*b-e*) can be shifted down respectively by 2, 4, 6, and 7 rows with respect to Table 1, if desired, to normalize the values. Please note that the first 11 rows of grid 184 have been omitted for clarity sake.

For each cell in grid 184, if at least one vehicle was detected for the particular zone and time frame represented by the cell, the cell was deemed to be occupied (or, in DBSCAN language, to have a point therein). Those cells have been darkened in grid 184. In contrast, if no vehicle was detected, the corresponding cell was deemed to be unoccupied (or to not have a point therein). Those cells are not darkened in grid 184. For use in DBSCAN, the distance between cells, whether horizontal or vertical, was considered to be one for adjacent cells, two for cells having a cell between them, and so forth.

Using empirical data to determine E and the minimum number of points, DBSCAN determined that there were several separate clusters represented by grid 184. The DBSCAN parameters are typically dependent on the specific zone size (s), the time step used, and the typical travel velocities and can be modified as required. Similar to the generation of Table 1, however, a count of the number of vehicles is not required to generate grid 184 or to perform DBSCAN based thereon.

Returning to FIG. 5, in step 174 each cluster identified in step 172 is analyzed to determine if the cluster qualifies as an upstream platoon. A two-step process can be performed to accomplish this step. First, the number of points of the cluster can be compared to a predetermined minimum number of points. If the number of points of the cluster is less than the predetermined number, the cluster is not categorized as an upstream platoon. This test can help to eliminate small clusters of vehicles, which tend to be small perturbations in the traffic flow rather than of platoons of vehicles traveling along a traffic corridor.

The predetermined number of points can be determined empirically, through experimentation, or by algorithm. Using empirical data, it was determined that for optimal results, the predetermined number of points can be set to 55. Of course, other values can also be used. If desired, the number of points variable used in DBSCAN (step 172) can be set to be the minimum number of points of a cluster, and this first step can thereby be eliminated. Using 55 as the predetermined number of points, all but two of the clusters represented by grid 184 were determined to not be upstream platoons.

Second, for those clusters having at least the minimum number of points therein, a scarcity ratio can be used to determine if the cluster can be categorized as an upstream platoon. The scarcity ratio is the ratio of total empty spaces to total filled spaces in a time space matrix of the cluster. As an example, if the total number of empty spaces in the time space matrix of a cluster=a and the total number of filled spaces=b, the scarcity ratio of the cluster equals a divided by b (i.e., "a/b").

Similar to DBSCAN grid 184, the time space matrix uses values from each of the different zones, such as from Table 1, to determine if corresponding cells are filled or empty. Unlike DBSCAN grid 184, however, only values for the cluster are used. As with the DBSCAN parameters, discussed above, the time space matrix values can be modified and are typically dependent on the specific zone size(s), the time step used, and the typical travel velocities. Also similar to the performance of DBSCAN, a count of the number of vehicles is not required to determine which clusters can be categorized as upstream platoons.

Figure 7A:
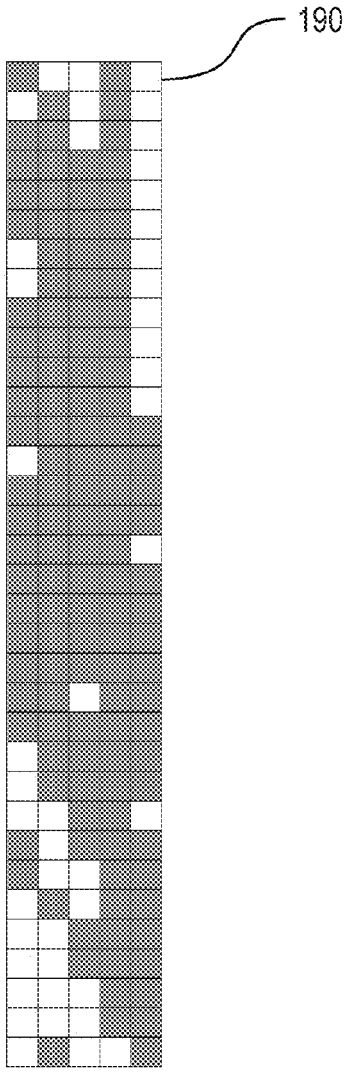
FIGS. 7A and 7B are visual representations of examples of time space matrices.
Figure 7B:
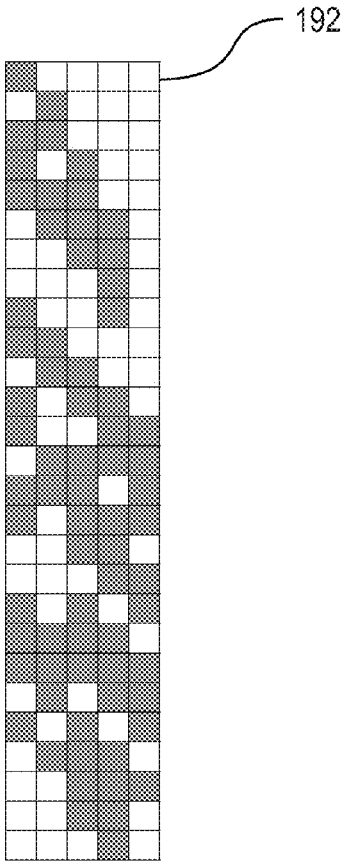

FIGS. 7A and 7B show examples of time space matrices 190 and 192 corresponding to two different clusters A and B. Time space matrix 190 includes a total of 170 spaces, of which 125 are filled and 45 are empty. Therefore, the scarcity ratio of cluster A is 45/125, or 0.36. Time space matrix 192 includes a total of 135 spaces, of which 70 are filled and 65 are empty. Therefore, the scarcity ratio of cluster B is 65/70, or 0.93.

The scarcity ratio of each cluster can be compared to a predetermined threshold value to determine if the cluster can be categorized as an upstream platoon. If the scarcity ratio is less than or equal to the predetermined threshold value, the cluster can be categorized as an upstream platoon. For example, if the predetermined threshold value is set to 0.7, then cluster A would be categorized as an upstream platoon and cluster B would not.

Using empirical data, it was determined that for optimal results, the predetermined threshold value can be set at 0.7. Of course, other threshold values can also be used. Using 0.7 as the predetermined threshold value, only one of the clusters represented by grid 184 was categorized as an upstream platoon.

Returning to FIG. 5, in step 176 each upstream platoon identified in step 174 is analyzed to determine the properties of the platoon. This can be done by analyzing and comparing the velocity of the vehicles of the platoon at the various zones. In one embodiment, a platoon velocity field can be generated for each upstream platoon.

Figure 8:
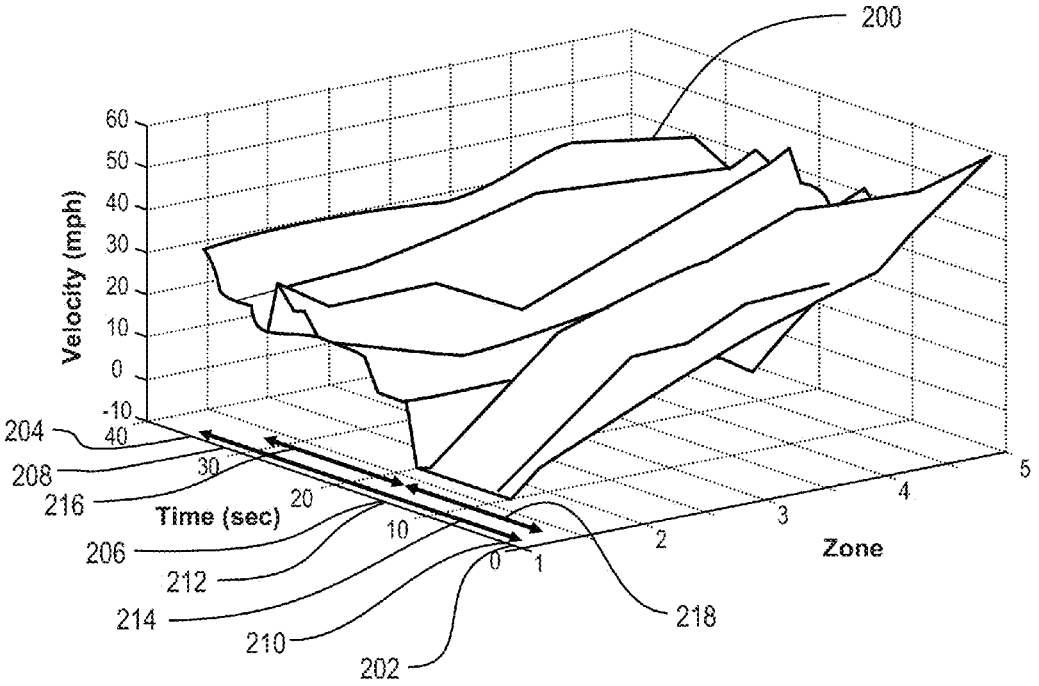
FIG. 8 a graphical representation of a platoon velocity field generated using traffic data associated with the platoon.

FIG. 8 shows a graphical representation of an example platoon velocity field 200 generated using traffic data associated with the upstream platoon. Platoon velocity field 200 reflects the flow of traffic as the traffic approaches the intersection by plotting the average velocity of the vehicles in each of the zones over the duration of the platoon. Similar to that discussed above, the data for each zone can be shifted before generating the platoon velocity field so that data across the zones correspond to the same vehicles at the same time. A nearest neighbor algorithm, as is known in the art, can be used to smoothen the type of interference and the centroid of the interference can be used to identify the type of interference (i.e., upper vs. lower vs. both). As with the steps above, a count of the number of vehicles is not required to generate the platoon velocity field.

From velocity field 200, a number of properties of the represented platoon can be determined. For example, the relative start and end times 202 and 204 of the platoon can be determined along with the relative start and end times 206 and 208 of soft type of interference and the relative start and end times 210 and 212 of hard type of interference experienced by the platoon. From these values, other properties can be calculated, such as the duration of the platoon 214, the time lengths 216 and 218 of the soft and hard interferences, the proportion of each type of interference, a determination of whether the interference was upper, lower, or both, etc.

Table 2 shows examples of platoon properties that were determined/calculated for a number of upstream platoons using a velocity field generated using the steps discussed herein.

TABLE 2

| Platoon ID | Start Time | End Time | Length (sec) | Hard Interference % of Platoon | Hard Interference Type | Soft Interference % of Platoon | Soft Interference Type |
|---|---|---|---|---|---|---|---|
| 3 | 9:10:41 | 9:11:24 | 44 | 22.72 | lower | 50.00 | lower |
| 5 | 9:14:47 | 9:15:37 | 51 | 52.94 | lower | 21.57 | lower |
| 81 | 10:30:38 | 10:31:25 | 48 | 43.75 | lower | 2.08 | lower |
| 145 | 11:24:03 | 11:24:32 | 30 | 0.00 | — | 6.67 | lower |

Although DBSCAN grid 184, time space matrices 190 and 192, and platoon velocity field 200 are depicted herein as grids and graphs, it is appreciated that those are simply graphical representations of process steps that occur on a computerized device and that the graphical representations are used herein to aid in the description of the steps of the processes. One of skill in the computer arts will appreciate that during the performance of the steps discussed herein on a computerized device, graphical representations of those items can be omitted.

Figure 9A:
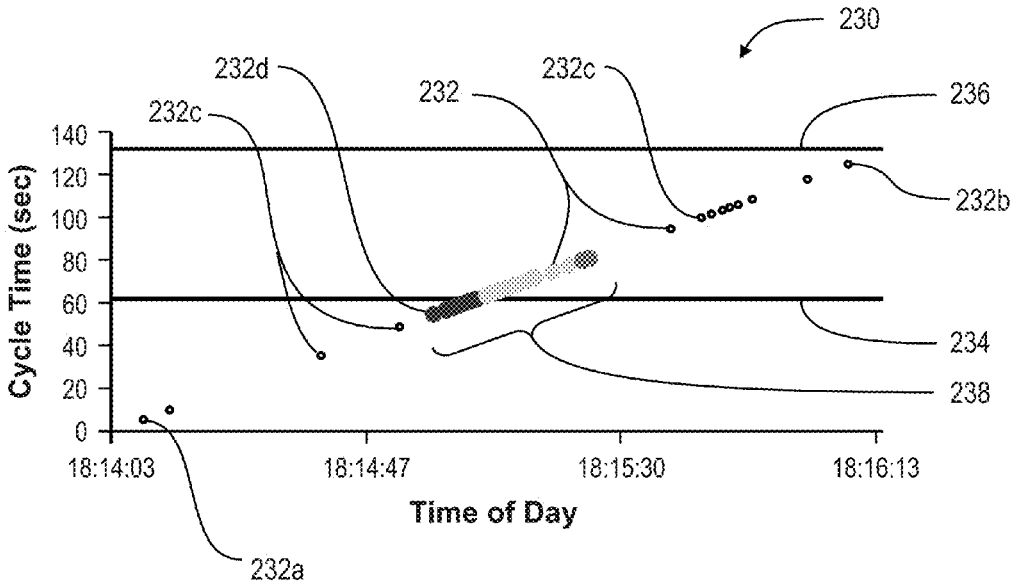
FIGS. 9A and 9B depict a single-cycle Enhanced Platoon Coordination Diagram according to one embodiment.

Returning to FIG. 5, in step 178 an EPCD is generated for the cycle using the information determined using the steps above. An example of an EPCD 230 is shown in FIG. 9A. For comparison purposes, EPCD 230 corresponds to the same cycle as PCD 150, discussed above and shown in FIG. 3. As with PCD 150, EPCD 230 shows the arrival time of each vehicle at the intersection and the time within the cycle that the traffic signal turned green ("go" line 234) and red ("stop" line 236). Data points 232 within EPCD 230 correspond to data points 152 of PCD 150. Thus, data points 232*a* and 232*b* on the lower left and upper right of EPCD 230 respectively represent the first and last vehicles to arrive at the intersection during the cycle.

In contrast to the PCD, however, the data points in the EPCD can be differentiated to give more information about the traffic flow based on the additional information determined about the cycle. For example, in EPCD 230, some data points 232*c* are smaller than others, and some data points 232*d* are colored, for reasons discussed in more detail below.

An EPCD can visually convey the same information as a PCD regarding the traffic arriving at the intersection. For example, similar to PCD 150, EPCD 230 can convey to a traffic engineer that approximately thirty-five vehicles arrived at the intersection during the cycle, with the majority of those vehicles (about twenty) arriving within about twenty seconds before or after the traffic signal turned green.

Because of the additional data used to generate an EPCD, however, more information regarding platoons can also be conveyed. For example, using the steps discussed above, an upstream platoon corresponding to data cluster 238 was determined to have occurred; therefore, the data points associated with data cluster 238 can be displayed differently than the data points not associated with the data cluster. As a result, the traffic engineer viewing an EPCD diagram does not have to make a guess as to if an upstream platoon has occurred and which vehicles comprise the platoon. Also, since the platoon determination is calculated by a computer it is likely to be performed in a more consistent and less biased manner.

Figure 9B:
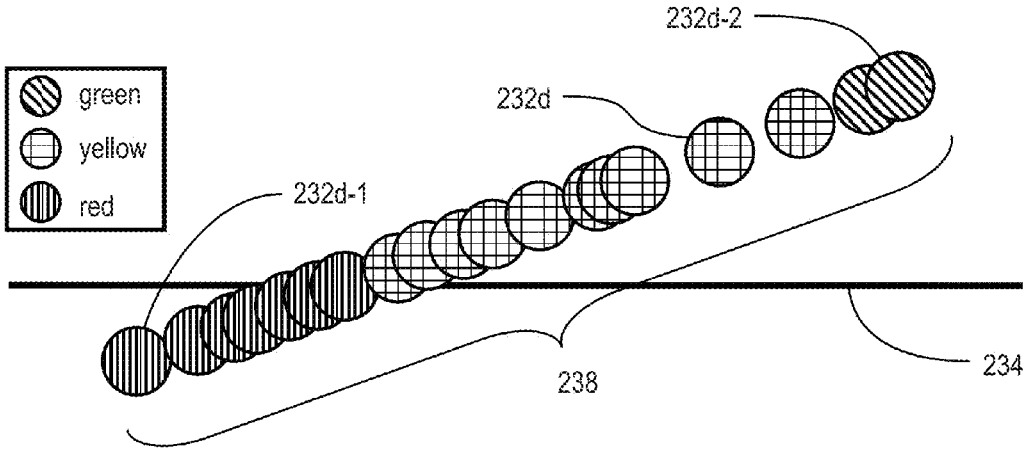

Furthermore, the data points corresponding to each vehicle in a platoon can be modified to show the type of interference, if any, encountered by the vehicle. For example, as shown in the close-up of FIG. 9B, each data point 232*d* corresponding to data cluster 238 can be represented in a color to reflect the type of interference encountered by the corresponding vehicle—e.g., red for hard interference, yellow for soft interference, and green for no interference.

By differentiating the types of interference encountered by each vehicle in an upstream platoon, the EPCD can give a traffic engineer a more complete picture of the traffic congestion occurring at the intersection. For example, from EPCD 230, the traffic engineer can definitively determine simply from their color that (1) the lead vehicles (represented by data points 232*d*-1) in the platoon experienced hard interference (i.e. came to a complete stop or had to substantially reduce speed, e.g., less than 5 mph), (2) the speed of the trail vehicles (represented by data points 232*d*-2) of the platoon generally experienced no interference, and (3) the vehicles in between the lead and trail vehicles experienced soft interference (i.e. were forced to slow down somewhat, but did not have to stop). In addition, because interference was experienced by the lead vehicles but not the trail vehicles, the traffic engineer can definitively determine that the type of platoon interference is lower interference.

Furthermore, because all of the above platoon information is determined using computerized devices, the information derived from EPCD 230 can be derived and used without generating a graphical representation of the EPCD, unlike a conventional PCD. That is, while a graphical representation of PCD 150 is typically produced to glean information about the cycle, step 178 can be completely performed within analysis engine 116 and data can be obtained therefrom without user viewing or input, if desired.

Figure 10A:
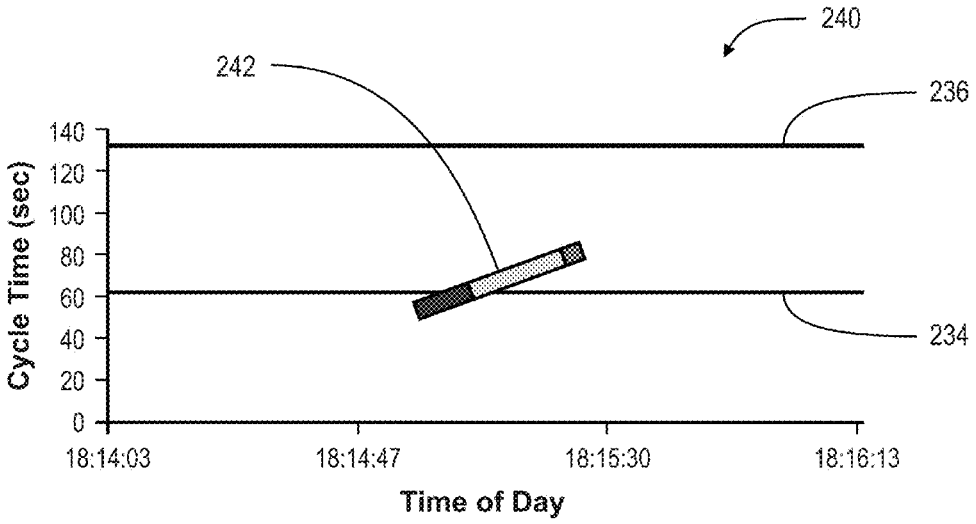
FIGS. 10A and 10B depict a single-cycle Enhanced Platoon Coordination Diagram according to another embodiment.

EPCD 230 requires a knowledge of how many vehicles were involved in the cycle as well as some information regarding each vehicle. If desired, however, an EPCD can be generated without differentiating between individual vehicles or without even determining the number of vehicles in the upstream platoon or in the cycle. For example, FIG. 10A shows an alternative embodiment of an EPCD 240 that corresponds to EPCD 230, except that the individual vehicles have been removed, leaving only a rectangular bar 242 corresponding to data cluster 238 of EPCD 230. Because steps 172, 174, and 176 of FIG. 5 can all be performed without a knowledge of the number of vehicles, EPCD 240 can be generated without a knowledge of the number of vehicles involved in the cycle and without specific information regarding any individual vehicle.

As discussed above with respect to FIG. 8, the relative times within the upstream platoon that the platoon experiences each type of interference can be determined from the platoon velocity field. As such, bar 242 can be divided into sections corresponding to the portions of the platoon that experienced the different types of interference using that data.

Figure 10B:
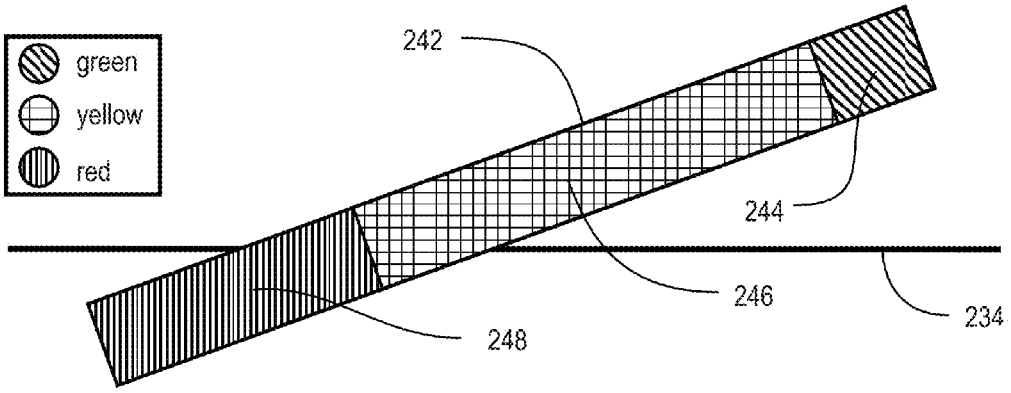

For example, as shown in the close-up of FIG. 10B, sections 244, 246, and 248 respectively show where in the platoon that no interference, soft interference and hard interference were experienced. As depicted, sections 244, 246, and 248 correspond to the groups of individual data points shown in FIG. 9B corresponding to the different types of interference. Thus, the platoon information can be calculated without using data from individual vehicles, if desired. This can help to simplify matters, especially if large platoons are involved. This can also help to minimize errors by the aggregation of data.

To alleviate traffic congestion at an intersection, the platoon information discussed above can be determined and analyzed for a consecutive series of cycles to determine trends, and traffic signal timing changes can be automatically determined. This data can be determined with or without knowledge of the number of vehicles in each platoon, as discussed above.

A multi-cycle EPCD can be generated that plots the above information for a consecutive series of cycles, similar to a multi-cycle PCD. To determine trends that occur over a period of time, the platoon information for consecutive cycles can be determined and analyzed and ultimately used to adjust traffic signal timing to help alleviate traffic congestion.

Figure 11:
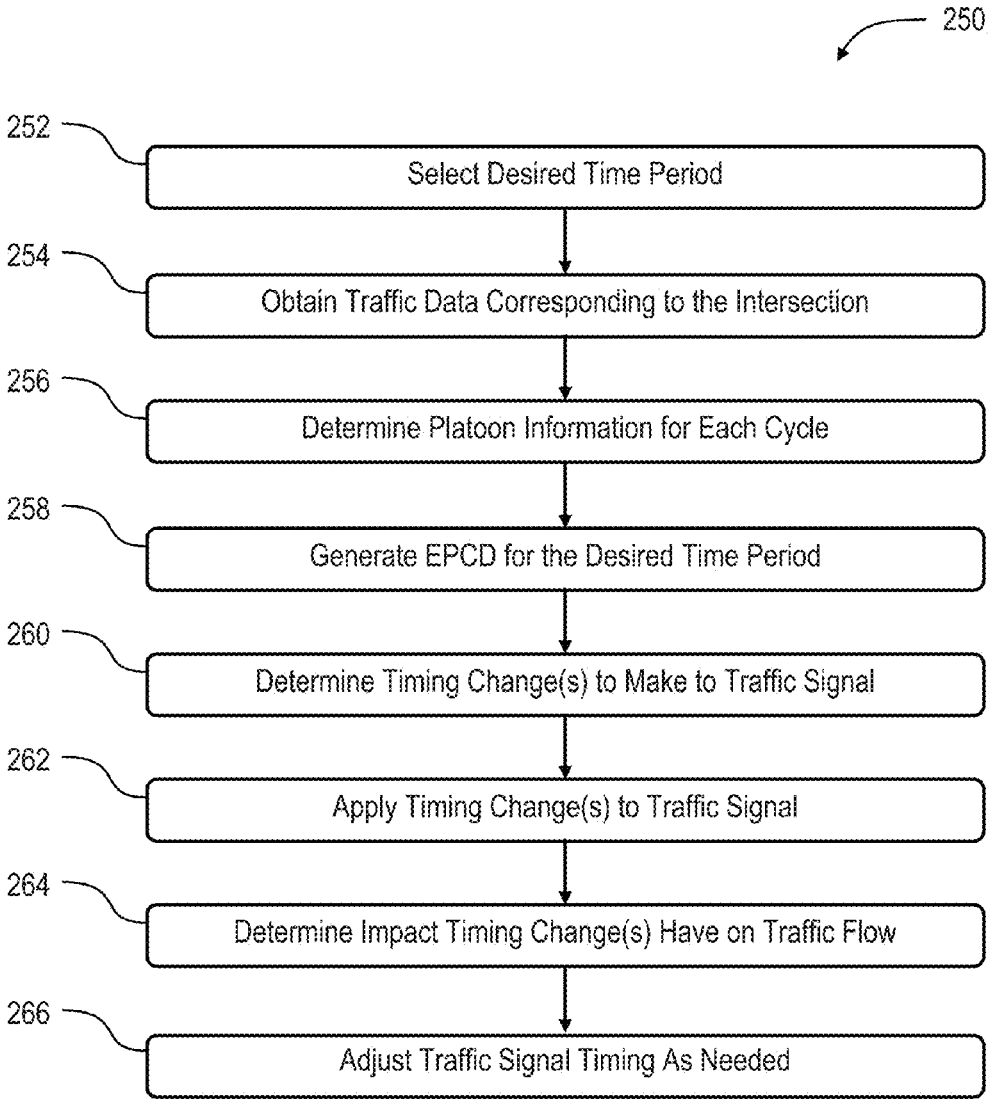
FIG. 11 illustrates a method of improving traffic flow through a signalized intersection according to one embodiment.

FIG. 11 illustrates one embodiment of a method 250 of improving traffic flow of an approach to a signalized intersection. Similar to method 170, method 250 can be performed at computing device 104 as a part of analysis engine 116 (FIG. 1), or can alternatively be performed at traffic monitor 102, user interface 106, or at any combination of traffic monitor 102, computing device 104, and user interface 106, or any other processing device or combination thereof.

In step 252, a desired time period is selected. The desired time period can be any time period measured in seconds, minutes, hours, days, months or even years. The time period can be contiguous. For example, the time period can identify a contiguous time period within a single day (e.g., all traffic on Dec. 2, 2012, from 9 am to 1 pm) or a contiguous time period that extends over multiple days (e.g., all traffic from 9 am on Dec. 2, 2012, to 9 am on Dec. 4, 2012).

The time period can also be non-contiguous (i.e., comprised of multiple sub-time periods). An example of a non-contiguous time period is a particular sub time-period each day for a particular amount of time (e.g., all traffic between 7 am and 10 am on every weekday morning for the past month). Of course, the above are only examples of time periods that can be used; any contiguous or non-contiguous time period can be used.

In step 254, traffic information for the selected time period is obtained from traffic monitor 102 and, if necessary, traffic signal controller 110, as discussed above. Also as discussed above, this step is typically performed after the traffic data has been saved at traffic monitor 102 (i.e., using previously recorded traffic data). However, this is not required. For example, the traffic data can be originally streamed to computing device 104 instead of being saved at traffic monitor 102 so that the data is already available at computing device 104. In that embodiment, step 254 can be omitted. Step 254 can also be omitted if method 250 is being performed at traffic monitor 102.

If traffic monitor 102 can coordinate the traffic data with the particular indications of the traffic signal, then the signal indication data portion of the traffic information can also be retrieved from the traffic monitor 102. If not, then the signal indication data can be retrieved from traffic signal monitor 110 and matched up with the traffic data by computing device 104 as discussed above. The signal indication data can include information regarding when the traffic signal was in the green indication, yellow indication, and red indication states for the particular approach.

If computing device 104 coordinates the signal indication data with the traffic data, the clocks of traffic monitor 102 and traffic signal monitor 110 should be synced or otherwise matched up so that the signal indication data and the traffic data can be coordinated. As discussed above, in some embodiments signal indication data is not required and thus does not need to be retrieved.

The traffic data can be transferred from traffic monitor 102 to computing device 104 in any manner known in the art. For example, the data can be transferred in one or more data files or as a packetized or non-packetized data stream. Any known format can be used, such as, e.g., eXtensible Markup Language (XML), JavaScript Object Notation (JSON), etc. Other transfer methods can also be used, as is known in the art.

In step 256, platoon information is determined/calculated for each cycle found in the desired time period. This can be accomplished by performing method 170, discussed above, for each cycle. Other approaches can also be used.

Figure 12:
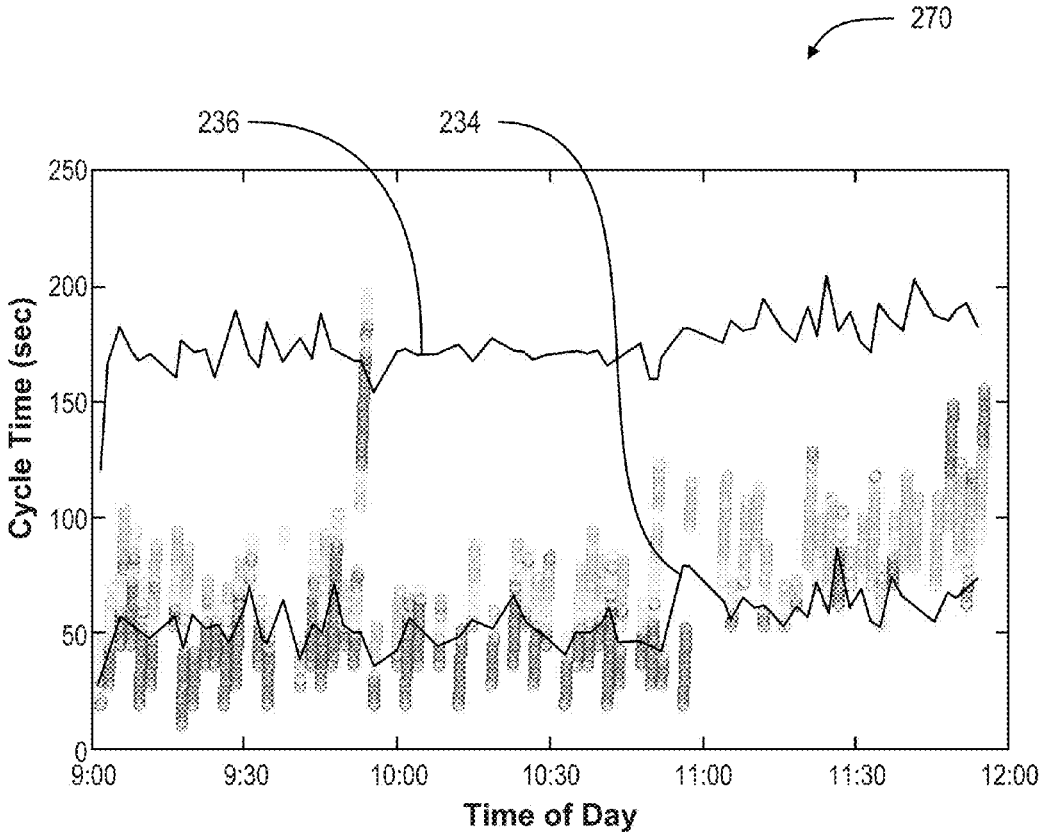
FIG. 12 depicts an example of a multi-cycle Enhanced Platoon Coordination Diagram according to one embodiment.

In step 258, a multi-cycle EPCD is generated for the desired time period. FIG. 12 depicts an example of a multi-cycle EPCD 270 according to one embodiment. In multi-cycle EPCD 270, the positions of the vehicles are plotted within the respective cycles over a period of time in a similar manner to multi-cycle PCD 160. Because data analysis of each cycle can determine when upstream platoons have occurred, data points that are not associated with upstream platoons have been disregarded (i.e., not plotted), in EPCD 160. This helps to clarify the diagram. Furthermore, if method 170 was used to determine the platoon information for each cycle, the single-cycle EPCD generated in method 170 can be omitted.

In light of the above, multi-cycle EPCD 270 only displays data points corresponding to clusters of vehicles that have been determined to be upstream platoons. Similar to single-cycle EPCD 230, discussed above, each data point in each platoon can be colored to convey the type and location of interference experienced by the corresponding vehicle in the platoon. For example, similar to single-cycle EPCD 230, each data point shown in multi-cycle EPCD 270 can be colored green, yellow, or red to respectively represent that the corresponding vehicle in the platoon experienced no, soft, or hard interference. To further clarify the diagram, the data points corresponding to the individual vehicles of a platoon can be replaced by a bar that includes sections corresponding to each type of interference experienced by the platoon, similar to single-cycle EPCD 240.

Multi-cycle EPCD 270 conveys more information than multi-cycle PCD 160 which can aid in preventing errors and allow the traffic engineer to make a more informed decision as to how to alleviate traffic problems corresponding to the intersection. For example, instead of guessing and estimating, as is done using conventional multi-cycle PCDs, the traffic engineer can clearly see from multi-cycle EPCD 270 each upstream platoon that has arrived at the intersection, as well as the start and stop times of the platoons.

In addition multi-cycle EPCD 270 also clearly conveys the types of interference experienced by each platoon as well as the location within the platoon of each type, something that cannot be deduced from a conventional multi-cycle PCD. As a result of this additional information, it is clear that the interference that is experienced by the upstream platoons arriving at the intersection before about 11 am is lower interference and that a significant portion of each of the platoons is being caused to come to a complete stop due to the interference.

As discussed above, because all of the platoon information is determined using computerized devices, the information derived from multi-cycle EPCD 270 can be derived and used without generating a graphical representation of the multi-cycle EPCD, similar to the single-cycle EPCD 230. This allows step 258 to be completely performed within analysis engine 116 and data can be obtained therefrom without user input, if desired.

Returning to FIG. 11, in step 260 one or more timing changes that can be made to the traffic signal to alleviate some or all of the traffic congestion are determined. Based on the additional information not found using conventional multi-cycle PCDs, desired changes to the traffic light timing can be more easily determined. Changes can be made to any cycle and the changes made can be the same for each cycle or can be different. For any cycle, the total duration of the cycle and/or the durations of any signal indication of the cycle can be changed. If the total duration of the cycle is to remain the same, then for any additional amount of time added to one signal indication, the duration of at least one of the other signal indications must be reduced by the same amount of time.

Figure 13:
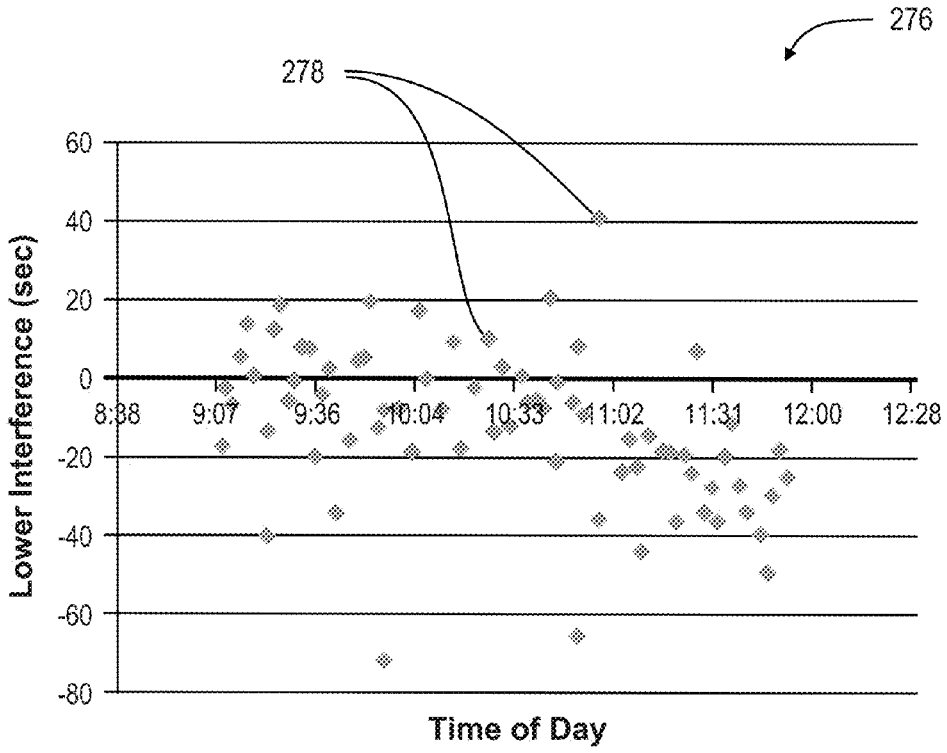
FIG. 13 depicts an example of an interference graph according to one embodiment.

In one embodiment, the timing of the head of each upstream platoon with respect to when the traffic signal turned green was used to determine timing changes to be made to the traffic signal. FIG. 13 is an interference graph 276 showing when the heads of each platoon (represented by data points 278) arrived at an intersection from a particular approach compared to when the traffic signal of the intersection corresponding to the approach turned green. The arrival time of the lead vehicle in the platoon was used.

On interference graph 276, zero on the y-axis corresponds to the time that the traffic signal turned green; positive y values (i.e. the area above the x-axis) correspond to the amount of time before the traffic signal turned green the lead vehicles of the platoons arrived at the intersection; negative y values (i.e. the area below the x-axis) correspond to time after the signal turned green.

Thus, the upstream platoons represented by the data points 278 positioned above the x-axis arrived at the intersection before the light turned green and therefore experienced interference. Changes to the traffic signal timing may have helped to reduce or even alleviate the interference experienced by those platoons.

In contrast, the upstream platoons represented by the data points 278 positioned below the x-axis arrived after the light turned green and therefore likely experienced no interference; changing the timing of the traffic light generally would likely not have reduced the interference experienced by those platoons. Therefore, to simplify the calculations, those platoons represented by data points 278 positioned below the x-axis have been ignored. However, if desired those platoons can also be factored into the calculations.

From the values shown in interference graph 276, lower interference occurs regularly between about 9:00 and about 11:00 for the intersection represented. A minimization algorithm was used to determine the optimal timing offset value for the traffic signal controller to use between those times of day. For graph 276, a shift of +12.6 seconds was calculated by analysis engine 116 to be optimal to best alleviate the lower interference problems experienced by the upstream platoons. That is, it was determined that having the traffic signal turn green 12.6 seconds earlier would alleviate most of the traffic congestion caused by the lower interference.

Returning to FIG. 11, in step 262 the timing changes calculated in step 260 are applied to the traffic signal to alleviate the interference experienced by the platoons. This can be performed manually by the traffic engineer or other qualified person or can be performed automatically by computing device 104 or other computing device. Manual adjustment may include the traffic engineer visually reviewing the automated results and accepting or revising the automatic optimization provided by the system. By doing so, the traffic engineer can remain in the loop. In this manner the system is not a "black box" to the traffic engineer, but it is open for review and can provide a wealth of insight. The option of keeping the engineer in the loop can allow the engineer to use additional information such as upcoming changes to the intersection or other considerations not factored in by the automatic method.

For example, changing the timing of a traffic signal with respect to one approach of an intersection is likely to have an effect on one or more of the other approaches of the intersection. The traffic engineer can take this into account when determining the adjustment to be made to the traffic signal controller.

In step 264 the traffic is again monitored to determine the impact the changed timing of the traffic signal has made to the traffic flow. By comparing the monitored information gathered before and after the traffic signal timing was changed, an objective measure of the traffic improvement can be obtained. This can be expressed in various ways, including, but not limited to, an increase in average speed of the traffic, an increase of number of vehicles per hour or other unit of time, a decrease in the number of upstream platoons that experience interference, a decrease in the number of vehicles that experience interference, etc. Traffic cameras can be accessed by the user to monitor the intersection after adjustments have been made.

Furthermore, various estimates can be made regarding benefits directly derived from the more efficient traffic flow. For example, estimates can be made of the amount of fuel that is saved, the reduction in emissions, e.g., CO2, the reduction in time spent traveling through the intersection, etc.

During this step, impacts made to the other phases and approaches of the intersection can also be determined.

In step 266, the traffic signal timing is adjusted as needed, based on the additional monitoring done in step 264, to optimize the traffic flow through the intersection. Depending on how optimized the traffic flow has become, this can range from making minor timing adjustments on the fly to beginning an EPCD analysis anew to anything in between. The traffic signal timing can also include changes to the timing of the other phases of the traffic signal, depending on the impact the original timing changes have had.

Figure 14:
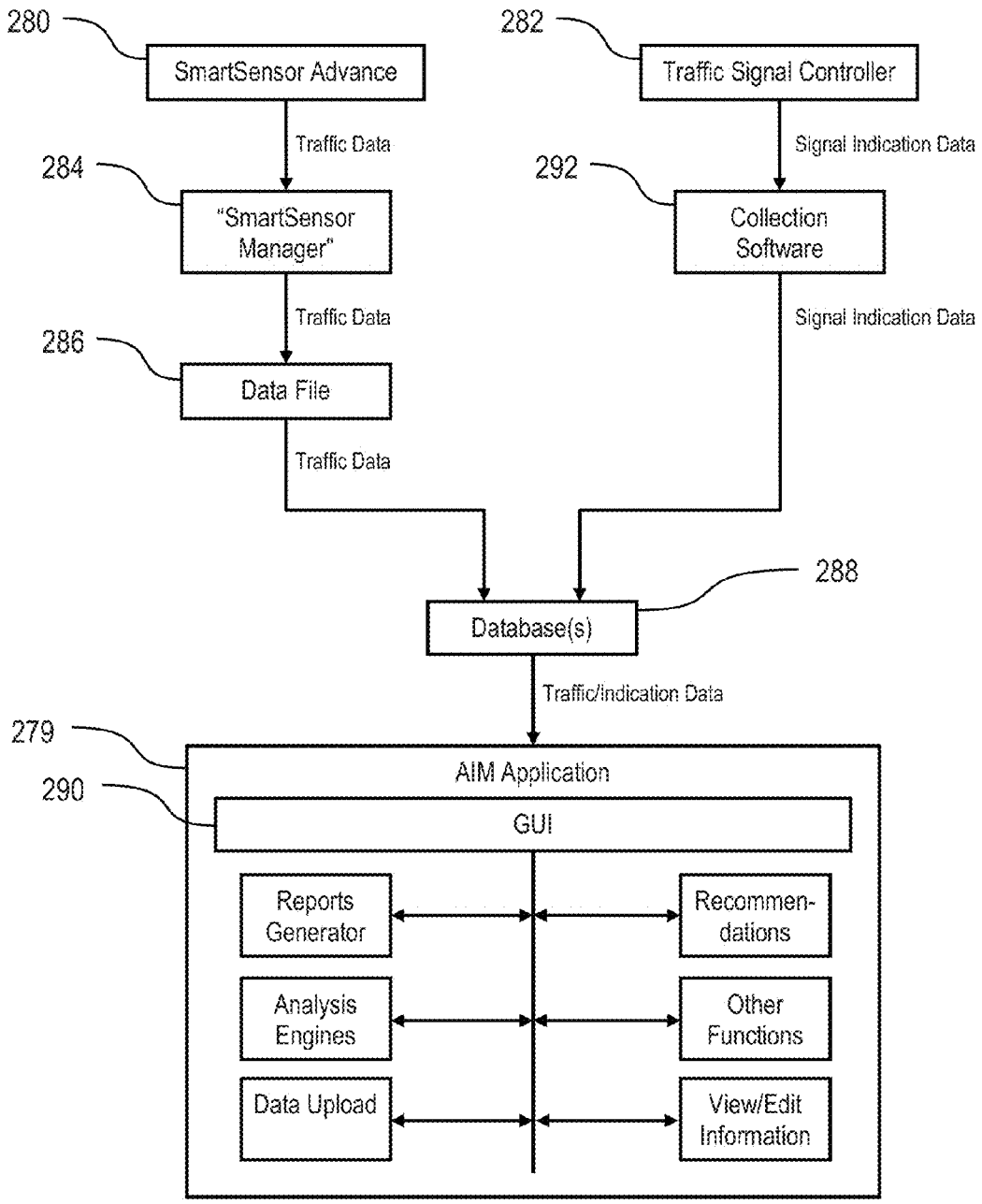
FIG. 14 is a block diagram showing a system for improving traffic flow through a signalized intersection according to one embodiment.

FIG. 14 is a block diagram showing an example software application 279, including various functional elements, that can be executed to allow a user to perform any or all of the method steps discussed above. FIG. 13 also shows an example data flow that can be used with the software application. The software application will be referred to herein as the Advanced Intersection Management application or the AIM application, for short.

In the exemplary configuration of FIG. 14, a SmartSensor Advance 280 is used as the traffic monitor. Traffic data from SmartSensor Advance 280 can be obtained by using SmartSensor Manager 284, a commercial software application designed to work with SmartSensor Advance 280 by Wavetronix. The traffic data can be stored in a data file 286 by SmartSensor Manager 284. The information in data file 286 can be stored in database(s) 288 using the AIM application 279 or using other software.

Signal indication data from traffic signal controller 282 can be obtained using collection software 292 that stores the data in database(s) 288. The function of the collection software can be accomplished using various commercially available software solutions. Once the traffic and signal indication data are in database(s) 288, the data can be used by the AIM application 279 to generate reports, make recommendations, etc. for the user.

The AIM application can include various functions related to traffic management using the EPCD discussed herein. Some of those functions are briefly discussed below. It will be appreciated that the functions discussed below are exemplary only and that other functions may also be included in an AIM application. It will also be appreciated that different AIM applications may include different functions, as applicable.

The AIM application can be a web application that is run by a user using a graphical user interface (GUI) 290 at user interface 106 (FIG. 1). The user can access the software application by browsing to a web address where the application is hosted. In one embodiment, computing device 104 (FIG. 1) can act as a web site which hosts the application. Data and other program elements can be exchanged between user interface 106 and computing device 104 over network 108 (FIG. 1), as is known in the art. The AIM application can alternatively be a stand-alone application or any other type of application known to one of skill in the computer arts.

The AIM application can be designed to allow a single user or multiple users to access traffic information for a single intersection or multiple intersections. To control access to the program, a username and password may be required for each user. Each user may also have an account to be able to customize various aspects of the program. For example, each user can have a list of intersections that are of particular significance to the user.

In some embodiments, the user can view and/or input intersection data. For example, in some embodiments, the user can view information about one or more intersections based on information stored in database(s) 288. By way of example and not limitation, the intersection information can include the location of the intersection, how many approaches the intersection has, the type of traffic signal controller that is being used to control the intersection, etc. If a user has rights, the user may also be able to modify some or all of the intersection information in the database. In some embodiments, the user can upload or manually enter the intersection data.

The uploaded or manually entered data can be added to an existing record in database(s) 288 corresponding to the intersection or, if no record is found, a new intersection record can be created and the data stored therein.

In some embodiments, the user can view and/or input data corresponding to one or more approaches for one or more of the intersections. For example, in some embodiments, the user can view information about each approach to an intersection based on information stored in database(s) 288. By way of example and not limitation, the approach information can include the direction of the traffic for the approach, the type of sensor(s) used to gather traffic information for the approach, etc. If a user has rights, the user may also be able to modify some or all of the information in the database for one or more of the approaches.

In some embodiments, the user can upload one or more traffic data files 286 corresponding to an intersection approach. In some embodiments, the AIM application can determine, from the selected file, the intersection and approach direction to which the traffic data file corresponds. The data from the selected traffic data file 286 can be added to an existing record in database(s) 288 corresponding to the intersection approach or, if no record is found, a new intersection approach record can be created and the traffic data stored therein. Once the traffic data is uploaded and stored in database(s) 288, the traffic data can be available for processing and report creation by the analysis engines in some embodiments. If a user has rights, the user may also be able to modify some or all of the imported traffic data.

In some embodiments, the user can create and view reports. For example, in some embodiments, reports can be created and/or viewed for one or more of the approaches stored in database(s) 288 corresponding to a selected intersection. To create a report for an intersection approach, the user can select a specific time period for which data has been recorded for the particular approach. By way of example and not limitation, reports that can be created and/or viewed in various embodiments can include EPCD, PCD, interference graph, cumulative volume, volume, volume/capacity ratio, platoon arrival ratio, cycle length, green time, platoon movement diagram, etc.

Because all of the data and reports are computerized, reports in some embodiments can be customized based on the data. For example, a user may only desire to view the information for those time periods where the upstream platoons have experienced interference, or where a specific type of interference has been experienced. These customized reports can be set up in some embodiments. Other customized reports may also be possible.

In some embodiments, the AIM application can calculate an optimal timing offset value for an intersection approach. The timing offset value calculated by the AIM application can be incorporated into traffic signal controller 282 to alleviate the traffic congestion at the intersection. As discussed above, this incorporation can be manually performed by the traffic engineer at the intersection.

It should be noted that changing the timing of the traffic signal with respect to one approach of an intersection is likely to have an effect on one or more of the other approaches of the intersection. Therefore, if an intersection has traffic data corresponding to more than one approach, the user may be able to determine a desired timing offset value for one of the approaches and then determine the likely ramifications that implementation of the timing offset value has on the other approaches. Using an iterative approach, the user can determine timing offset values for each approach that optimizes traffic flow from all directions through the intersection In some embodiments, the user can alter the timing of the traffic signal controller 282 directly from the AIM application.

In some embodiments, some or all of the various functions discussed above can be automated. For example, in some embodiments of the AIM application, data can be automatically recorded and retrieved from one or more of the intersections, including on a periodic basis, such as e.g., weekly; in some embodiments, reports can be automatically generated. In some embodiments, a user can set up a notification so that the user is notified whenever one or more of the types of interference is detected to have occurred. In some embodiments, timing offset values can be automatically applied to traffic signal controllers 282, if desired. Other automated functions can also be allowed by various embodiments of the AIM application.

In some embodiments, the AIM application can be customized. By way of example and not limitation, the following threshold variables may be user-settable in various embodiments: minimum platoon size (number of cars), minimum platoon density, soft interference threshold (mph), hard interference threshold (mph), maximum cycle length (i.e., % over average cycle length to exclude), number of empty data rows to skip within a platoon, and low speed exclusion (i.e., minimum mph of vehicles approaching an intersection at a distance that are not adjacent to other vehicles).

Figure 15:
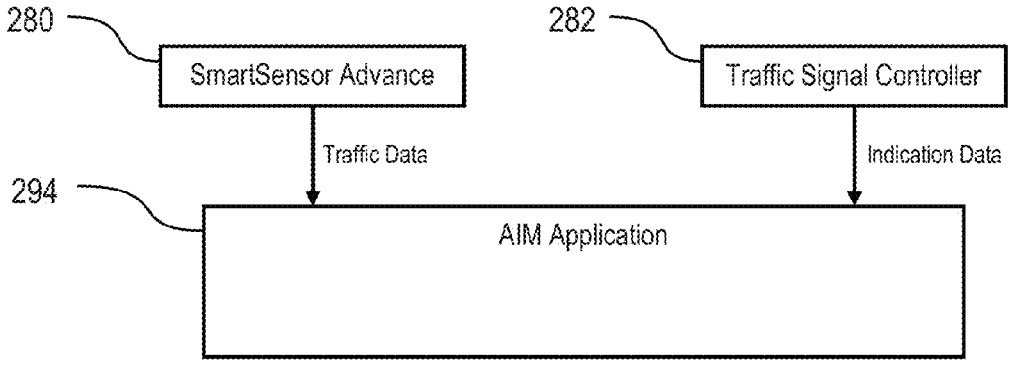
FIG. 15 is a block diagram showing a system for improving traffic flow through a signalized intersection according to another embodiment.

In some system embodiments, the AIM application can incorporate one or more of the functions of data collection and storage shown as being external to the AIM application in FIG. 14. For example, FIG. 15 is a block diagram showing an embodiment of an AIM application 294 in which all of the external data collection and storage functions have been incorporated therein, thus eliminating the need for the external SmartSensor Manager, data files, and indication data collection software. As such, AIM application 294 can interface directly with the traffic monitor (i.e., SmartSensor Advance 280) and traffic controller 282. This embodiment may be beneficial if automation is used, as it allows AIM application 294 to control more of the data flow to and from the system devices.

It is appreciated that the AIM applications discussed above are but a few of the embodiments of a computer application that can be implemented according to the present invention. Other computer applications can also be implemented.

Embodiments of the present application enable traffic engineers to improve intersection performance by offering advanced measurements of intersection traffic flow and allowing easy access to that information. For example, the traffic engineer can log data corresponding to an intersection for a period of days, upload the data for analysis, make adjustments to the traffic signal timing based on the results of the analysis and then monitor the intersection and make further adjustments, as necessary.

Once data for a number of intersections of a municipality or other community has been recorded and stored in database(s) 288, grid and corridor coordination can be performed by taking into account data for adjacent intersections when analyzing traffic data. In this manner, traffic engineers can create the best possible traffic flow by using the unique traffic detection and analysis tools of the present invention.

The present invention may be embodied in other specific forms without departing from its spirit or essential characteristics. Accordingly, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A computer system for monitoring traffic flow, comprising:

one or more processors; and one or more computer-readable media having stored thereon executable instructions that when executed by the one or more processors configure the computer system to perform at least the following:

receive traffic information from one or more radar traffic sensors that are positioned along a roadway;

identify a cluster of one or more vehicles from the traffic information that was received from the one or more radar traffic sensors, wherein identifying a cluster comprises:

creating a grid representative of the traffic information, the grid comprising entries corresponding to multiple zones of traffic for multiple time periods, wherein each cell of the grid is deemed to be occupied or unoccupied dependent on whether at least one vehicle was detected in the corresponding zone of traffic during the time represented by the cell; and identify the clusters using cluster identification algorithms of the occupied cells;

calculate properties of the one or more vehicles based on the traffic information received from the one or more radar traffic sensors, wherein the properties include a type of interference respectively experienced by the one or more vehicles; and generate an Enhanced Platoon Coordination Diagram (EPCD) based on the calculated properties of the one or more vehicles, wherein the EPCD displays an arrival times of the one or more vehicles relative to a signal cycle phase and further comprises:

a set of visual distinctions within the one or more vehicles that indicate the type of interference respectively experienced by the one or more vehicles, wherein the set of visual distinctions comprises a first visual indication for each vehicle that experiences hard interference and a second, different visual indication for each vehicle that experiences soft interference.

2. The computer system recited in claim 1, wherein the executable instructions include instructions that when executed configure the computer system to:

determine that the cluster represents a group of vehicles that do not qualify as an upstream platoon.

3. The computer system recited in claim 1, wherein the executable instructions include instructions that when executed configure the computer system to:

determine that the cluster represents a group of vehicles that qualifies as an upstream platoon by:

determining that a number of vehicles in the cluster is greater than or equal to a predetermined minimum number of vehicles;

determining that a density of vehicles in the cluster is greater than or equal to a predetermined minimum density; or determining that an extent of the cluster is greater than or equal to a predetermined minimum extent.

4. The computer system recited in claim 3, wherein the executable instructions for calculating properties of the one or more vehicles further comprise executable instructions that when executed configure the computer system to:

generate a velocity field based on the traffic information; and use the velocity field to determine a total interference experienced within the upstream platoon or a total delay experienced traveling through an intersection.

5. The computer system of claim 3, wherein the executable instructions for calculating properties of the upstream platoon further comprise executable instructions that when executed configure the computer system to calculate:

a duration of the upstream platoon;

a relative start time and a relative end time of hard interference experienced by the upstream platoon;

a total interference experienced within the upstream platoon or a total delay experienced traveling through an intersection; and a relative start time and a relative end time of soft interference experienced by the upstream platoon.

6. The computer system recited in claim 3, wherein the executable instructions for calculating properties of the upstream platoon further comprise executable instructions that when executed configure the computer system to:

determine interference experienced by the upstream platoon; and determine whether the interference is upper interference, lower interference, or both.

7. The computer system recited in claim 3, wherein the executable instructions for generating the Enhanced Platoon Coordination Diagram further comprise executable instructions that when executed configure the computer system to represent vehicles in the upstream platoon differently than vehicles not in the upstream platoon.

8. The computer system recited in claim 1, wherein the set of visual distinctions comprises color coding.

9. The computer system recited in claim 1, wherein the set of visual distinctions comprises differences in depicted visual data points.

10. The computer system recited in claim 1, wherein the set of visual distinctions is selected from a group consisting of color coding, sizes, shapes, icons, lines, and hashing.

11. A computer-implemented method for improving traffic flow, the method comprising:

obtaining, by a computer device having a processor, traffic information corresponding to an intersection having a traffic signal, wherein the traffic information is received from a radar traffic sensor;

determining, by the computer device, platoon properties associated with a platoon, based on the traffic information received from the radar traffic sensor, wherein determining platoon properties comprises:

creating a grid representative of the traffic information, the grid comprising entries corresponding to multiple zones of traffic for multiple time periods, wherein each cell of the grid is deemed to be occupied or unoccupied dependent on whether at least one vehicle was detected by the radar traffic sensor in the corresponding zone of traffic during the time represented by the cell;

identifying clusters of occupied cells using cluster identification algorithms;

determining that the number of occupied cells in at least a portion of the grid is greater than or equal to a predetermined minimum number;

determining that the density of occupied cells in at least the portion of the grid is greater than or equal to a predetermined minimum density;

determining that the extent of the occupied cells in at least the portion of the grid is greater than or equal to a predetermined minimum extent;

calculating, by the computer device, a timing change to make to the traffic signal to improve traffic flow through the intersection, the timing change being based on the platoon properties, determining an impact that the timing change to the traffic signal has on traffic flow through the intersection; and adjusting the timing of the traffic signal to minimize a total interference experienced within the upstream platoon or a total delay experienced traveling through an intersection.

12. The computer-implemented method recited in claim 11, wherein obtaining the traffic information corresponding to the intersection comprises:

selecting a desired time period; and obtaining previously recorded traffic information corresponding to the intersection for the desired time period.

13. The computer-implemented method recited in claim 11, further comprising generating an Enhanced Platoon Coordination Diagram (EPCD) that represents vehicles that experience hard interference in the platoon differently than vehicles that experience soft interference in the platoon.

14. The computer-implemented method recited in claim 11, wherein determining the platoon properties comprises determining an amount of hard interference and an amount of soft interference experienced by the platoon.

15. A system for monitoring traffic flow, comprising:

a radar traffic sensor that records traffic information corresponding to an approach of an intersection;

a computing device that receives the traffic information from the radar traffic sensor and generates an Enhanced Platoon Coordination Diagram (EPCD) based on the traffic information, the computing device comprising a processor and memory; and a user interface configured to display to a user the EPCD generated by the computing device, wherein the computing device identifies one or more clusters of vehicles from the traffic information and determines that a cluster of the one or more clusters represents a group of vehicles that qualifies as an upstream platoon by:

determining that a number of vehicles in the cluster is greater than or equal to predetermined minimum number of vehicles;

determining that a density of vehicles in the cluster is greater than or equal to a predetermined minimum density; or determining that an extent of the cluster is greater than or equal to a predetermined minimum extent;

wherein the EPCD comprises:

a first set of visual distinctions that distinguish individual vehicles within upstream platoons from vehicles not in the upstream platoons, wherein the first set of visual distinctions comprises displaying the individual vehicles within upstream platoons differently than at least a portion of other vehicles displayed within the EPCD.

16. The system for monitoring traffic flow recited in claim 15, wherein the computing device is configured to calculate a timing change to make to a traffic signal of the intersection to improve traffic flow through the intersection, the timing change being directed towards minimizing a total interference experienced within the upstream platoon or a total delay experienced by the upstream platoon traveling through the intersection.

17. The system for monitoring traffic flow recited in claim 15, wherein the radar traffic sensor comprises a radar sensor that concurrently records traffic data corresponding to separate zones of the intersection approach.

18. The system for monitoring traffic flow recited in claim 17, wherein the radar sensor concurrently records traffic data corresponding to nine or fewer separate zones.

19. The system for monitoring traffic flow recited in claim 15, wherein the first set of visual distinctions comprises displaying each individual upstream platoon as a separate bar.

20. The system for monitoring traffic flow recited in claim 15, wherein the computing device comprises a database that stores traffic information corresponding to a plurality of intersections.

21. The system for monitoring traffic flow recited in claim 15, wherein the computing device comprises an analysis engine to analyze the traffic information and a reports generator to generate reports based on the traffic information corresponding to the intersection.

22. The system for monitoring traffic flow recited in claim 15, further comprising:

a second set of visual distinctions within one or more displayed upstream platoons that indicates a type of interference experienced by one or more vehicles in the upstream platoon, wherein the second set of visual distinctions comprises different visual indications for groups of vehicles within the upstream platoon based upon the type of interference experienced by the respective groups of vehicles.

23. The system for monitoring traffic flow recited in claim 22, further comprising:

a set of visual distinctions between one or more displayed upstream platoons that indicate one or more distinct upstream platoons, wherein the set of visual distinctions comprise different visual indications for each respective platoon.

24. A method of improving traffic flow, the method comprising:

detecting, with a single radar traffic sensor, vehicles within a traffic stream along a continuous longitudinal section of a roadway;

tracking, with the single radar traffic sensor, the detected vehicles as the vehicles propagate towards a signalized intersection;

identifying clusters of vehicles within the traffic stream based upon the tracking of the vehicles;

determining which clusters belong to upstream platoons arriving at the intersection by:

determining that a number of vehicles in the cluster is greater than or equal to a predetermined minimum number of vehicles;

determining that a density of vehicles in the cluster is greater than or equal to a predetermined minimum density; or determining that an extent of the cluster is greater than or equal to a predetermined minimum extent;

determining a magnitude of soft interference and hard interference experienced by one or more vehicles, wherein the magnitude of soft interference and hard interference is determined from information received from the single radar traffic sensor;

determining properties of the upstream platoons based on the determined magnitude of soft interference and hard interference;

calculating, by a computer device, a timing change to make to a traffic signal to improve traffic flow through the signalized intersection, the timing change being based on the determined magnitude of soft interference and hard interference;

changing the timing of the traffic signal to incorporate the calculated timing change;

determining an impact that the timing change to the traffic signal has on the traffic flow through the intersection; and adjusting the timing of the traffic signal to minimize a total interference experienced with the upstream platoon or a total delay experienced traveling through an intersection.

25. The method recited in claim 24, wherein tracking the detected vehicles as the vehicles propagate towards a signalized intersection comprises determining range and speed information for the vehicles as the vehicles approach the signalized intersection.

26. The method recited in claim 24, wherein the arrival of each upstream platoon at the intersection is correlated with the cycles of a traffic signal of the intersection.

27. The method recited in claim 26, further comprising generating an Enhanced Platoon Coordination Diagrams (EPCD) for each cycle of the traffic signal.

28. The method recited in claim 24, further comprising automatically generating an array of information about one or more upstream platoons, wherein the array of information comprises a respective platoon start time, a respective platoon end time, a respective platoon length, a percentage of the respective upstream platoon that experiences hard inference, and a percentage of the respective upstream platoon that experiences soft interference.

29. The method recited in claim 24, further comprising calculating a velocity field for each of the upstream platoons.

30. A computer system for monitoring traffic flow, comprising:

one or more processors; and one or more computer-readable media having stored thereon executable instructions that when executed by the one or more processors configure the computer system to perform at least the following:

receive traffic information from one or more radar traffic sensors that are positioned along a roadway;

identify a cluster of one or more vehicles from the traffic information that was received from the one or more radar traffic sensors;

determine that the cluster represents a group of vehicles that qualifies as an upstream platoon by:

determining that a number of vehicles in the cluster is greater than or equal to a predetermined minimum number of vehicles;

determining that a density of vehicles in the cluster is greater than or equal to a predetermined minimum density; or determining that an extent of the cluster is greater than or equal to a predetermined minimum extent;

calculate properties of the one or more vehicles based on the traffic information received from the one or more radar traffic sensors to identify a type of interference respectively experienced by the one or more vehicles; and generate an Enhanced Platoon Coordination Diagram (EPCD) based on the calculated properties of the one or more vehicles, wherein the EPCD displays the arrival times of the one or more vehicles relative to a signal cycle phase and further comprises:

a set of visual distinctions within the one or more vehicles that indicate the type of interference respectively experienced by the one or more vehicles, wherein the set of visual distinctions comprises a first visual indication for each vehicle that experiences hard interference and a second, different visual indication for each vehicle that experiences soft interference.

31. The computer system recited in claim 30, wherein the executable instructions for determining that a density of occupied cells in the cluster is greater than or equal to a predetermined minimum density further comprise executable instructions that when executed configure the computer system to determine that a scarcity ratio of the cluster is less than or equal to a predetermined threshold value.

32. The method recited in claim 31, wherein the scarcity ratio is a ratio of total empty spaces to total filled spaces in a time-space matrix of the cluster.

* * * * *